US009663884B2

(12) United States Patent
Hashimoto

(10) Patent No.: US 9,663,884 B2
(45) Date of Patent: May 30, 2017

(54) METHOD FOR PREVENTING SEAM RAVEL OF MULTI-THREAD CHAIN STITCHES, SEAM RAVEL PREVENTING APPARATUS FOR MULTI-THREAD CHAIN STITCH SEWING MACHINE, AND MULTI-THREAD CHAIN STITCH SEAM STRUCTURE

(75) Inventor: Seiji Hashimoto, Osaka (JP)

(73) Assignee: Yamato Sewing Machine Mfg. Co., Ltd., Osaka (JP)

( * ) Notice: Subject to any disclaimer, the term of this patent is extended or adjusted under 35 U.S.C. 154(b) by 604 days.

(21) Appl. No.: 14/342,806

(22) PCT Filed: Sep. 5, 2012

(86) PCT No.: PCT/JP2012/073246

§ 371 (c)(1),
(2), (4) Date: Mar. 5, 2014

(87) PCT Pub. No.: WO2013/039079

PCT Pub. Date: Mar. 21, 2013

(65) Prior Publication Data

US 2014/0224159 A1 Aug. 14, 2014

(30) Foreign Application Priority Data

Sep. 13, 2011 (JP) ..... 2011-220511
Nov. 9, 2011 (JP) ..... 2011-259543

(51) Int. Cl.
*D05B 1/10* (2006.01)
*D05B 93/00* (2006.01)
(Continued)

(52) U.S. Cl.
CPC ..... *D05B 1/10* (2013.01); *D05B 1/12* (2013.01); *D05B 53/00* (2013.01); *D05B 55/14* (2013.01);
(Continued)

(58) Field of Classification Search
CPC ..... D05B 93/00; D05B 61/00; D05B 1/20; D05B 57/02; D05B 73/12; D05B 65/00; A41D 27/10
(Continued)

(56) References Cited

U.S. PATENT DOCUMENTS 1,030,784 A * 6/1912 La Chapelle ..... D05B 73/12 112/34
2,487,988 A * 11/1949 Zeier ..... D05B 93/00 112/413
(Continued)

FOREIGN PATENT DOCUMENTS

JP 11-57268 A 3/1999
JP 2879399 B2 4/1999
(Continued)

*Primary Examiner* — Tejash Patel
(74) *Attorney, Agent, or Firm* — Walter | Haverfield LLP; D. Peter Hochberg; Sean F. Mellino

(57) ABSTRACT

A method for preventing seam ravel of multi-thread chain stitches is provided. After normal sewing is terminated with a looper set in a forward movement state, a state in which a needle thread loop caught by the looper is subjected to position-holding at a position closer to a forward movement end of the looper than a descent position of a needle is maintained until the needle descends through the needle thread loop caught by the looper. Thereafter, the position-holding of the needle thread loop is released to permit a sewing action for at least one stitch, thereby allowing the needle thread loop to be self-looped with a needle thread held by the needle. This surely strongly prevents the seam ravel of multi-thread chain stitches formed by the single needle, irrespective of the dimension of tension applied to the needle thread and the looper thread.

7 Claims, 27 Drawing Sheets

(51) Int. Cl.

| | |
|---|---|
| ***D05B 65/02*** | (2006.01) |
| ***D05B 65/06*** | (2006.01) |
| ***D05B 53/00*** | (2006.01) |
| ***D05B 55/14*** | (2006.01) |
| ***D05B 1/12*** | (2006.01) |

(52) U.S. Cl.
CPC ..... *D05B 65/02* (2013.01); *D05B 65/06* (2013.01); *D05B 93/00* (2013.01)

(58) Field of Classification Search
USPC ..... 112/438, 475.17, 162, 165, 433, 441, 112/197, 288, 291
See application file for complete search history.

(56) References Cited

U.S. PATENT DOCUMENTS 2,696,795 A * 12/1954 Kirsch ..... D05B 93/00 112/438
5,381,745 A * 1/1995 Nolle ..... D05B 93/00 112/255
5,722,338 A * 3/1998 Douyasu ..... D05B 1/10 112/165
5,881,663 A * 3/1999 Tsukioka ..... D05B 3/14 112/156
6,119,613 A * 9/2000 Douyasu ..... D05B 1/10 112/197
6,401,640 B2 * 6/2002 Tanaka ..... D05B 1/10 112/200
6,422,165 B1 * 7/2002 Tanaka ..... D05B 61/00 112/165
7,404,367 B2 * 7/2008 Yasuzawa ..... D05B 1/08 112/197
7,497,177 B2 * 3/2009 Tanaka ..... D05B 65/02 112/292
8,943,985 B2 * 2/2015 Hashimoto ..... D05B 1/10 112/165
2006/0231002 A1 * 10/2006 Tanaka ..... D05B 65/02 112/2
2014/0076222 A1 * 3/2014 Hashimoto ..... D05B 1/10 112/475.17

FOREIGN PATENT DOCUMENTS

JP 2006-314762 A 11/2006
JP 2011-206527 A 10/2011

* cited by examiner

METHOD FOR PREVENTING SEAM RAVEL OF MULTI-THREAD CHAIN STITCHES, SEAM RAVEL PREVENTING APPARATUS FOR MULTI-THREAD CHAIN STITCH SEWING MACHINE, AND MULTI-THREAD CHAIN STITCH SEAM STRUCTURE

CROSS-REFERENCE TO RELATED APPLICATIONS

This application is a 371 National Stage application of International Application No. PCT/JP2012/073246, filed on Sep. 5, 2012, which claims priority of Japanese application Serial Number 2011-220511 filed on Sep. 13, 2011 and Japanese application Serial Number 2011-259543 filed on Nov. 9, 2011, all of which are incorporated herein by reference in their entireties.

BACKGROUND OF THE INVENTION

Field of the Invention

The present invention relates to a method for preventing seam ravel of multi-thread chain stitches in which multi-thread chain stitch seams are formed with a needle thread and a looper thread by using a multi-thread chain stitching sewing machine, typically represented by a horizontal tube type one, and it is configured to prevent seam ravel from occurring at an end portion of the multi-thread chain stitch seams. The present invention also relates to a seam ravel preventing apparatus for a multi-thread chain stitch sewing machine, and a multi-thread chain stitch seam structure.

Description of the Prior Art

Background Art

A multi-thread chain stitch sewing machine of general horizontal tube type or the like includes a needle moving up and down while holding a needle thread, and a looper which moves forward and backward while holding a looper thread in a direction substantially orthogonal to a vertical movement path of the needle. The multi-thread chain stitch sewing machine forms multi-thread chain stitch seams on a fabric by repeating the step in which a needle thread loop formed below a needle plate by the needle is caught by the forward movement action of the looper, and the step in which the needle thread is interloped with the looper thread held by the looper.

SUMMARY OF INVENTION

Technical Problem

General multi-thread chain stitch seams M formed by the multi-thread chain stitch sewing machine have suffered from the following problem. That is, as shown in FIG. 27, when an end portion of a looper thread 10 cut at the end of sewing is pulled in a direction indicated by the arrow in FIG. 27, the looper thread 10 disengages from the last needle thread loops 20*a* and 20*b* respectively formed by needle threads 20 and 20. The disengagement is likely to propagate toward a sewing start point, thus causing ravel throughout the entirety of the seams M.

Although FIG. 27 shows the multi-thread chain stitch seams formed by the two needle threads 20 and 20 and the looper thread 10, the foregoing ravel similarly occurs in multi-thread chain stitch seams formed by a single needle thread and a looper thread.

As a method for preventing the ravel peculiar to the seams formed by the multi-thread chain stitch sewing machine, such a method as disclosed in Japanese patent No. 2879399 has heretofore been proposed. That is, after a normal sewing is terminated with the looper set in its forward movement state, a sewing action for one stitch is performed in a state in which the looper thread passed through the needle thread loop by the forward movement of the looper is held at a position closer to the forward movement end of the looper, and thereafter the needle thread and the looper thread are cut.

As shown in FIG. 28, the conventionally proposed method for preventing ravel forms the seams M in which the looper thread 10 positionally held by a looper thread hanging hook is interloped and tangled with final needle thread loops 20*a* and 20*b* formed by the needle threads 20 and 20 during the sewing action for one stitch after the normal sewing. The tangled looper thread 10 cannot be disengaged from the final needle thread loops 20 and 20*b* even if the end portion of the looper thread 10 is pulled in the direction of arrow x. It is therefore possible to prevent ravel of the seams M.

FIG. 28 shows a state in which the multi-thread chain stitch seams formed by these two needle threads 20 and 20 and the looper thread 10 are prevented from raveling. When this is applied to the multi-thread chain stitch seams M formed by the single needle thread 20 and the looper thread 10, as shown in FIG. 29, the seams M in which the looper thread 10 is interlooped and tangled with the final needle thread loop 20*a* formed by the single needle thread 20, resulting in a ravel prevented state in which the looper thread 10 is not disengaged from the final needle thread loop 20*a*.

Thus, the conventionally proposed method for preventing seam ravel can prevent the occurrence of ravel peculiar to the multi-thread chain stitch seams as much as possible.

However, the conventionally proposed method for preventing seam ravel has suffered from the problem that when tension is applied in the direction of arrow y in FIGS. 28 and 29, a cut end portion of the looper thread 10 is apt to disengage from the final needle thread loops 20*a*, 20*b* and 20*a*, and once the disengagement occurs, the disengagement of the looper thread 10 proceeds sequentially toward a sewing start point, and ravel occurs throughout the seams.

For example, when the fabric is thin or soft, sewing is carried out with a low tension applied to the needle thread and the looper thread in order to obtain an excellent sewing finishing. Therefore, fastening of the needle thread loops 20*a* and 20*b*, and fastening of the looper thread 10 via the needle thread loops 20*a*, 20*b* and 20*a* becomes insufficient, and hence the foregoing ravel is more likely to occur.

Particularly for multi-thread chain stitch seams formed by the single needle, the looper thread 10 is only interlooped and tangled with the final single needle thread loop 20*a* of the needle thread 20. Therefore, disengagement occurs only by application of slight tension, resulting in extremely low ravel preventing effect.

CITATION LIST

Patent Literature

Japanese patent No. 2879399

SUMMARY OF THE PRESENT INVENTION

Solution to Problem

The present invention has been made in view of the foregoing circumstances, and an object thereof is to provide a method for preventing seam ravel of multi-thread chain stitches by which the occurrence of seam ravel in multi-thread chain stitch seams formed with a single needle can be surely strongly prevented irrespective of the dimension of tension applied to the needle thread and the looper thread, and also provide a seam ravel preventing apparatus for a multi-thread chain stitch sewing machine, and a multi-thread chain stitch seam structure.

According to a first aspect of the present invention, there is provided a method for preventing seam ravel of multi-thread chain stitches, which are formed by catching a needle thread loop formed below a needle plate by a needle moving up and down while holding a needle thread, by a forward movement of a looper movable forward and backward in a direction substantially orthogonal to a vertical movement path of the needle, and by interlooping the needle thread loop with a looper thread held by the looper. The method includes, after a normal sewing is terminated with the looper set in a forward movement state, maintaining a state in which the needle thread loop caught by the looper is subjected to position holding at a position closer to a forward movement end of the looper than a descent position of the needle until the needle descends through the needle thread loop caught by the looper; and thereafter, selflooping the needle thread loop with the needle thread held by the needle by releasing the position holding of the needle thread loop so as to permit a sewing action for at least one stitch which includes a descent of the needle through the needle thread loop.

According to a second aspect of the present invention, there is provided a method for preventing seam ravel of multi-thread chain stitches formed by catching a needle thread loop formed below a needle plate by a needle moving up and down while holding a needle thread, by a forward movement of a looper movable forward and backward in a direction substantially orthogonal to a vertical movement path of the needle, and by interlooping the needle thread loop with a looper thread held by the looper. The method includes, after a normal sewing is terminated with the looper set in a forward movement state, maintaining a state in which the needle thread loop caught by the looper is subjected to position holding at a position closer to a forward movement end of the looper than a descent position of the needle until the needle descends through the needle thread loop caught by the looper; and thereafter, selflooping the needle thread loop with the needle thread held by the needle by releasing the position holding of the needle thread loop so as to permit a sewing action for at least one stitch which includes a descent of the needle through the needle thread loop, under conditions that the feed of the fabric is suspended or the feed has a lower feed rate than during the normal sewing.

According to a third aspect of the present invention, there is provided a seam ravel preventing apparatus for a multi-thread chain stitch sewing machine which is installed in a multi-thread chain stitch sewing machine for forming multi-thread chain stitch seams on a fabric, and prevents ravel of the seams. The multi-thread chain stitch sewing machine includes a single needle moving up and down while holding a needle thread, and a looper which is movable forward and backward while holding a looper thread in a direction substantially orthogonal to a vertical movement path of the needle, and catches a needle thread loop formed below a needle plate by the needle during a forward movement of the looper. The multi-thread chain stitch sewing machine forms the multi-thread chain stitch seams by interlooping the needle thread loop caught by the forward movement of the looper with the looper thread held by the looper. The seam ravel preventing apparatus includes a needle thread holding mechanism which is accessible to and departable from the looper, and holds the needle thread loop caught by the looper during an access motion of the needle thread holding mechanism, at a position closer to a forward movement end of the looper than a descent position of the needle; and a control section for controlling the access motion and a departure motion of the needle thread holding mechanism in association with actions of the needle and the looper, and feed of the fabric. The control section terminates a normal sewing by setting the looper at a forward movement position and the needle at an ascent position, and then maintains a state in which the needle thread loop is subjected to position holding at a position closer to a forward movement end of the looper than a descent position of the needle by allowing the needle thread holding mechanism to create the access motion, until the needle descends through the needle thread loop caught by the looper. Thereafter, the control section releases the position holding of the needle thread loop so as to perform a sewing action for at least one stitch which includes a descent of the needle through the needle thread loop in synchronization with descent and ascent of the needle, the forward and backward movements of the looper, and the feed of the fabric.

According to a fourth aspect of the present invention, there is provided a seam ravel preventing apparatus for a multi-thread chain stitch sewing machine which is installed in a multi-thread chain stitch sewing machine for forming multi-thread chain stitch seams on a fabric, and prevents ravel of the seams. The multi-thread chain stitch sewing machine includes a single needle moving up and down while holding a needle thread, and a looper which is movable forward and backward while holding a looper thread in a direction substantially orthogonal to a vertical movement path of the needle, and catches a needle thread loop formed below a needle plate by the needle during a forward movement of the looper. The multi-thread chain stitch sewing machine forms the multi-thread chain stitch seams by interlooping the needle thread loop caught by the forward movement of the looper with the looper thread held by the looper. The seam ravel preventing apparatus includes a needle thread holding mechanism which is accessible to and departable from the looper, and holds the needle thread loop caught by the looper during an access motion of the needle thread holding mechanism, at a position closer to a forward movement end of the looper than a descent position of the needle; and a control section for controlling the access motion and a departure motion of the needle thread holding mechanism in association with actions of the needle and the looper, and teed of the fabric. The control section terminates a normal sewing by setting the looper at a forward movement position and the needle at an ascent position, and then maintains a state in which the needle thread loop is subjected to position holding at a position closer to a forward movement end of the looper than a descent position of the needle by allowing the needle thread holding mechanism to create the access motion, until the needle descends through the needle thread loop caught by the looper. Thereafter, the control section releases the position holding of the needle thread loop so as to perform a sewing action for at least one stitch which includes a descent of the needle through the needle thread loop in synchronization with descent and ascent of the needle, the forward and backward movements of the looper, and the feed of the fabric, under conditions that the feed of the fabric is suspended or the feed has a lower feed rate than during the normal sewing.

According to a fifth aspect of the present invention, there is provided a multi-thread chain stitch seam structure formed on a fabric by the method for preventing seam ravel of multi-thread chain stitches. At least a needle thread loop lying at a terminal end in a sewing direction among needle thread loops formed on a rear surface of the fabric is selflooped with a needle thread passing through the fabric.

According to a sixth aspect of the present invention, there is provided a multi-thread chain stitch seam structure formed on a fabric by the seam ravel preventing apparatus for the multi-thread chain stitch sewing machine. At least a needle thread loop lying at a terminal end in a sewing direction among needle thread loops formed on a rear surface of the fabric is selflooped with a needle thread passing through the fabric.

In the methods for preventing seam ravel of multi-thread chain stitches according to the first or second aspect of the present invention, and in the seam ravel preventing apparatuses for the multi-thread chain stitch sewing machine according to the third or fourth aspect thereof, and in the multi-thread chain stitch seam structure according to the fifth or sixth aspect thereof, each aspect having the corresponding foregoing characteristic feature, after the normal sewing is terminated with the looper set in the forward movement state, the state in which the needle thread loop caught by the looper is subjected to position holding at the position closer to the forward movement end of the looper than the descent position of the needle is maintained until the needle descends through the needle thread loop caught by the looper. Thereafter, the position holding of the needle thread loop is released to perform the sewing action for at least one stitch which includes the descent of the needle through the needle thread loop. Thereby, the preceding needle thread loop is selflooped with the needle thread held by the descending needle, and the looper thread is pressed by the selflooped portion. This prevents disengagement of the looper thread irrespective of the dimension of tension applied to the needle thread and the looper thread, thereby surely preventing a seam ravel in its developmental stage.

Particularly, as described in the second and fourth aspect of the present invention, the sewing action for at least one stitch for the purpose of ravel prevention by means of selflooping is carried out under the conditions that the feed of the fabric is suspended or the feed has the lower feed rate than during the normal sewing. Thus, the selflooped portion can be tightened, thus enhancing the pressing of the looper thread by means of the selflooped portion. It is therefore capable of more surely preventing the disengagement of the looper thread at the end of sewing, and the occurrence of seam ravel resulting therefrom.

In the method for preventing seam ravel of multi-thread chain stitches according to the second aspect of the present invention, and the seam ravel preventing apparatus for the multi-thread chain stitch sewing machine according to the fourth aspect thereof, it is preferable to suppress the feed of the looper thread to the looper after the looper thread is positioned at a position ahead of or behind the descent position of the needle.

In this case, a predetermined tension is applicable to the looper thread extending from the front end of the looper to the fabric. This enhances tightening of the looper thread, thereby preventing disengagement of the looper thread. Consequently, the looper thread after thread cutting has a short length, and the appearance of seams is improved, thereby enhancing seam quality.

In the method for preventing seam ravel of multi-thread chain stitches and the seam ravel preventing apparatus for the multi-thread chain stitch sewing machine according to the second and fourth aspects of the present invention, respectively, it is preferably set to start execution of the suspension of the feed of the fabric or execution of the feed having the lower feed rate than during the normal sewing in the sewing action for the at least one stitch for the selflooping after the needle thread loop is positioned closer to the forward movement end of the looper than the descent position of the needle.

In this case, the sewing action for at least one stitch for the purpose of selflooping is carried out by performing the suspension of the feed of the fabric or the feed having the lower feed rate after the needle thread loop as a target of selflooping is positioned closer to the forward movement end of the looper than the descent position of the needle. Therefore, compared to the case of terminating sewing after thread cutting in the normal sewing, the ravel prevention can be performed without increasing operating time of the sewing machine immediately before terminating the sewing. This allows for sure complete selflooping, thus achieving more reliable seam ravel prevention.

Further in the method for preventing seam ravel of multi-thread chain stitches and the seam ravel preventing apparatus for the multi-thread chain stitch sewing machine according to the second and fourth aspects of the present invention, respectively, it is preferably set to start execution of the suspension of the feed of the fabric or execution of the feed having the lower feed rate than during the normal sewing in the sewing action for the at least one stitch for the selflooping at a certain stage before the needle thread loop is positioned closer to the forward movement end of the looper than the descent position of the needle.

In this case, the execution of the suspension of the feed of the fabric or the execution of the feed having the lower feed rate than during the normal sewing is started before the sewing action for at least one stitch for the purpose of selflooping is started. This eliminates excess fabric feed even when the sewing machine is rotated by a substantially half-turn so that the needle ascends to a top dead center or its vicinity in order to start the sewing action for one stitch for the purpose of seam ravel prevention. This minimizes the pitch of seams at the end of sewing, thus further improving an intended seam ravel prevention effect by means of selflooping.

Particularly, when execution of the suspension of the feed of the fabric or execution of the feed having the lower feed rate than during the normal sewing in the sewing action for at least one stitch for the selflooping is set to start at a certain time prior to at least one and a half stitches or more before the needle thread loop is positioned closer to the forward movement end of the looper than the descent position of the needle, the pitch of seams by means of interlooping prior to selflooping is reduced. It is therefore capable of preventing the looper thread from disengaging with both the selflooped portion and the interlooped portion, thereby further improving the ravel prevention effect.

In the seam ravel preventing apparatus for the multi-thread chain stitch sewing machine according to the third or fourth aspect of the present invention, the single needle to be used may be attached to a vertically moving needle bar so as to be positioned on an extension line of a center of the needle bar, or may be attached to the vertically moving needle bar so as to be positioned at a location displaced toward the forward movement side of the looper with respect to the extension line of the center of the needle bar.

In the method for preventing seam ravel of multi-thread chain stitches according to the second aspect of the present invention, the following manner may be preferable. That is, when after the normal sewing is terminated, the needle thread loop caught by the looper is subjected to position holding at a location closer to the forward movement end of the looper than the descent position of the needle, the looper thread extending from the looper to the fabric is subjected to position holding at a position ahead of or behind the descent position of the needle; the state so obtained is maintained until the needle descends through the needle thread loop caught by the looper; and the position holding of the needle thread loop and the looper thread is released to perform the sewing action for at least one stitch. Similarly, in the seam ravel preventing apparatus for the multi-thread chain stitch sewing machine according to the third or fourth aspect of the present invention, it may be preferable to include a looper thread holder separately from the needle thread holding mechanism. The looper thread holder is accessible to and departable from the looper, and holds a looper thread extending from the looper to a fabric during an access motion thereof, at a position ahead of or behind the descent position of the needle.

In these cases, similarly to the needle thread holding mechanism, after the normal sewing is terminated with the looper set in the forward movement state, the looper thread extending from the looper to the fabric is held at the position ahead of or behind the descent position of the needle by the looper thread holder. Thereby, not only the needle thread but also the looper thread can be surely positioned. This achieves more reliable selflooping and more reliable seam ravel prevention effect.

The time that the looper thread extending from the looper to the fabric is subjected to the position holding at the position ahead of or behind the descent position of the needle is preferably set at the same time or substantially the same as time that the needle thread loop caught by the looper is subjected to the position holding at the position closer to the forward movement end of the looper than the descent position of the needle.

In the seam ravel preventing apparatus for the multi-thread chain stitch sewing machine including the looper thread holder according to the third or fourth aspect of the present invention, the looper thread holder is accessible to and departable from the looper integrally with the needle thread holding mechanism. Alternatively, the looper thread holder may be accessible to and departable from the looper separately from the needle thread holding mechanism.

When the looper thread holder is accessible to and departable from the needle thread holding mechanism integrally with the needle thread holding mechanism, the driving mechanism of the needle thread holding mechanism is also usable as the driving mechanism of the looper thread holder. This allows the overall structure of the seam ravel preventing apparatus to become more compact and simpler, thus reducing costs.

When the looper thread holder is configured separately from the needle thread holding mechanism, adjustments or the like to the timing of action and the amount of action between the needle thread holding mechanism and the looper thread holder can be performed individually, thus making it easier to obtain timing and an amount of action which are satisfactory to and appropriate for both.

In the seam ravel preventing apparatus for the multi-thread chain stitch sewing machine including the looper thread holder, access and departure timing and/or a locus of action of the looper thread holder with respect to the looper is preferably adjustable.

In this case, for example, before an actual sewing, a mechanical running test (trial sewing) can be performed to inspect the timing of action and/or the locus of action of the looper thread holder with respect to the needle thread holding mechanism. Then, on the basis of the inspection results, optional adjustments for obtaining appropriate timing, of action and/or locus of action can be performed to avoid mutual adverse effects and action disorder between the looper thread holder and the needle thread holding mechanism. Consequently, the coexistence and cooperation of the looper thread holder and the needle thread holding mechanism ensure selflooping and further enhance the intended seam ravel prevention effect.

In the seam ravel preventing apparatus for the multi-thread chain stitch sewing machine according to the third or fourth aspect of the present invention, the needle thread holding mechanism includes a thread hanging hook which swings around a vertically extending support shaft in a plane substantially parallel to the needle plate between a standby position away from the looper and a hooking position adjacent to the looper; and a hook actuator for drivingly swinging the thread hanging hook to the standby position and the hooking position. The needle thread holding mechanism further includes a stopper mechanism having (i) a stopper member which is disposed at a position farther away from the needle plate than the thread hanging hook of the needle thread holding mechanism, and is capable of suspending and unsuspending a swing of the thread hanging hook from the hooking position to the standby position so that a needle thread loop caught by the thread hanging hook at the thread hooking position is held at a hold position between the thread hooking position and the standby position, and (ii) a stopper actuator for performing suspension (temporary stop) and unsuspension of the stopper member; and a connecting member for interlockingly connecting the thread hanging hook of the needle thread holding mechanism and the stopper member of the stopper mechanism. The control section allows the needle thread loop caught at the thread hooking position by the thread hanging hook to be held between the thread hooking position and the standby position in abutment against the stopper member by selectively controlling the hook actuator and the stopper actuator.

In this case, during the seam ravel prevention action, related actions of the thread hanging hook and the stopper member surely swing the thread hanging hook among the thread hanging position to catch the needle thread loop, and the standby position away from the looper, and the hold position between these two positions, and also surely stops the thread hanging hook at the individual positions. This achieves sure reliable seam ravel prevention action by means of selflooping.

The stopper mechanism in the foregoing needle thread holding mechanism preferably includes a stopper member which is directly connected to the hook actuator and moves linearly reciprocatingly; a swing lever engageable with and disengageable from a part of the stopper member; a spring for swingingly energizing the swing lever in a direction in which the thread hanging hook is positioned at the standby position; and the stopper actuator for disengaging the swing lever from the part of the stopper member against an energizing force of the spring.

In this case, in the reciprocating movements of the stopper member of the stopper mechanism, the energizing force of the spring can be effectively used for return movement. Therefore, the stopper actuator is required to produce driving force only in one direction. Hence, the stopper actuator may have a simple inexpensive structure.

The hook actuator of the needle thread holding mechanism and the stopper actuator of the stopper mechanism are preferably both air cylinders. Furthermore, both of the air cylinders are preferably fixedly supported in a vertical two-stage fashion on a cylinder attachment base fixedly installed in the sewing machine bed.

In this case, the thread hanging hook in the needle thread holding mechanism and the stopper member in the stopper mechanism can be operated with excellent responsiveness on the basis of the control signal from the control section, thereby surely efficiently performing seam ravel prevention action after the normal sewing. Additionally, the space occupied by these two air cylinders can be minimized to permit easy compact installation thereof into the sewing machine bed.

Electromagnetic solenoid or the like may be used as the hook actuator and the stopper actuator.

The seam ravel preventing apparatuses in the third and fourth aspects of the present invention are suitable for application to a horizontal tube type multi-thread chain stitch sewing machine. Alternatively, both may be applied to 1-needle multi-thread chain stitch sewing machine and a flat-bed multi-thread chain stitch sewing machine.

The above and other aspects, features, and advantages of the present invention will be apparent from the following detailed description of exemplary embodiments.

DETAILED DESCRIPTION OF THE PRESENT INVENTION

Description of Embodiments

Figure 1:
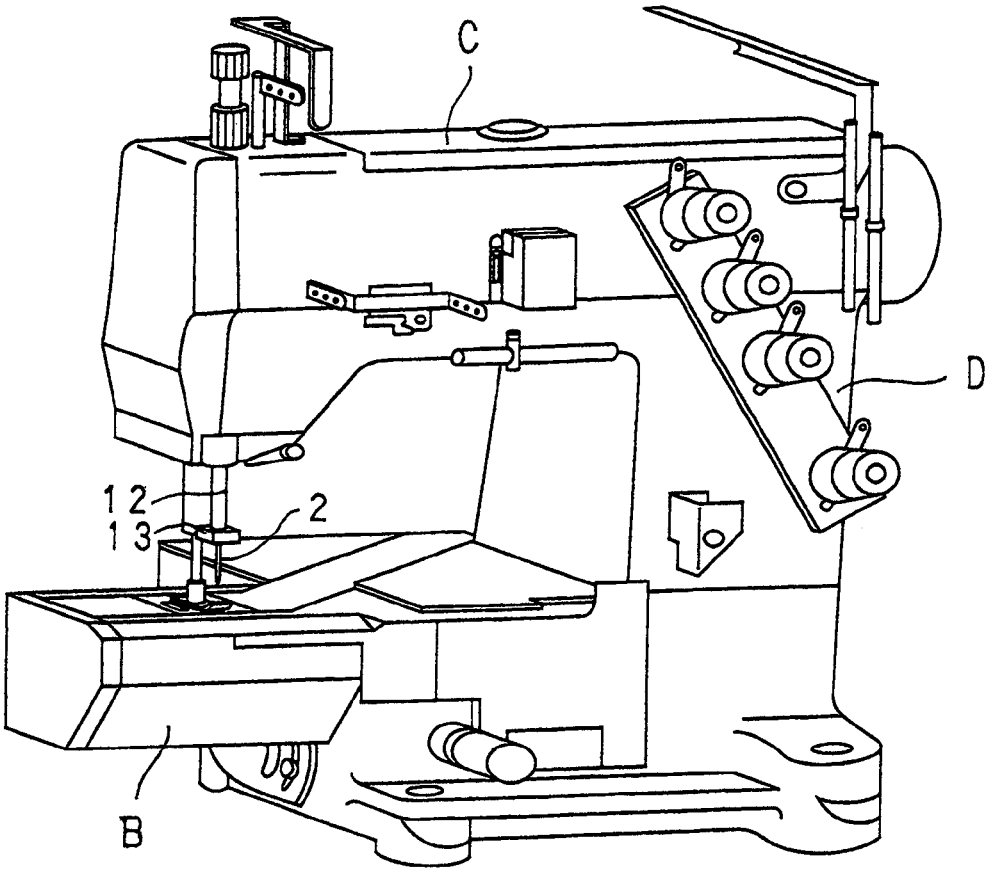
FIG. 1 is a perspective view showing a general appearance of a horizontal tube type multi-thread chain stitch sewing machine according to a first embodiment of the present invention.
Figure 2:
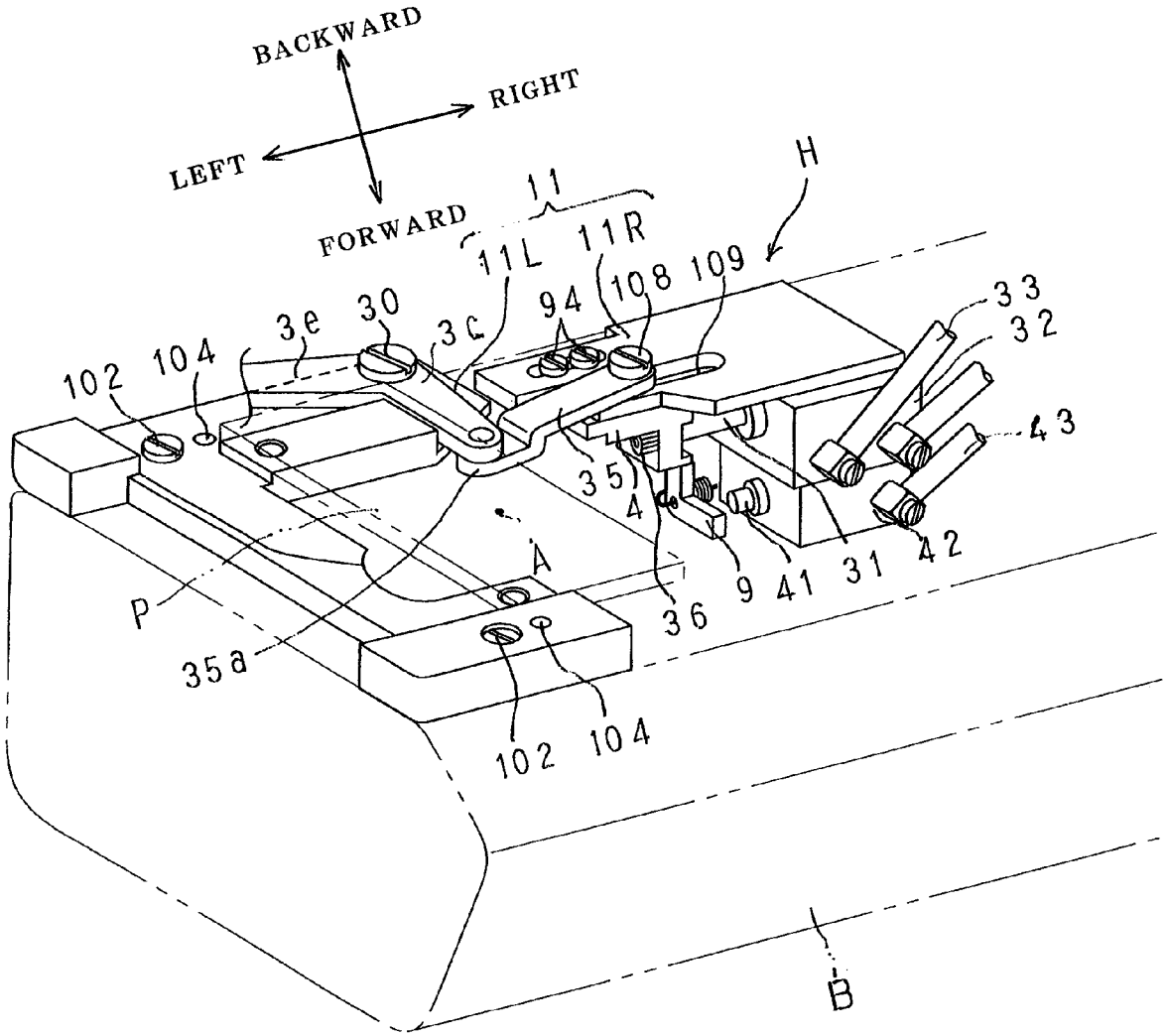
FIG. 2 is a perspective view showing the structure of the main parts of a seam ravel preventing apparatus in the horizontal tube type multi-thread chain stitch sewing machine.
Figure 3:
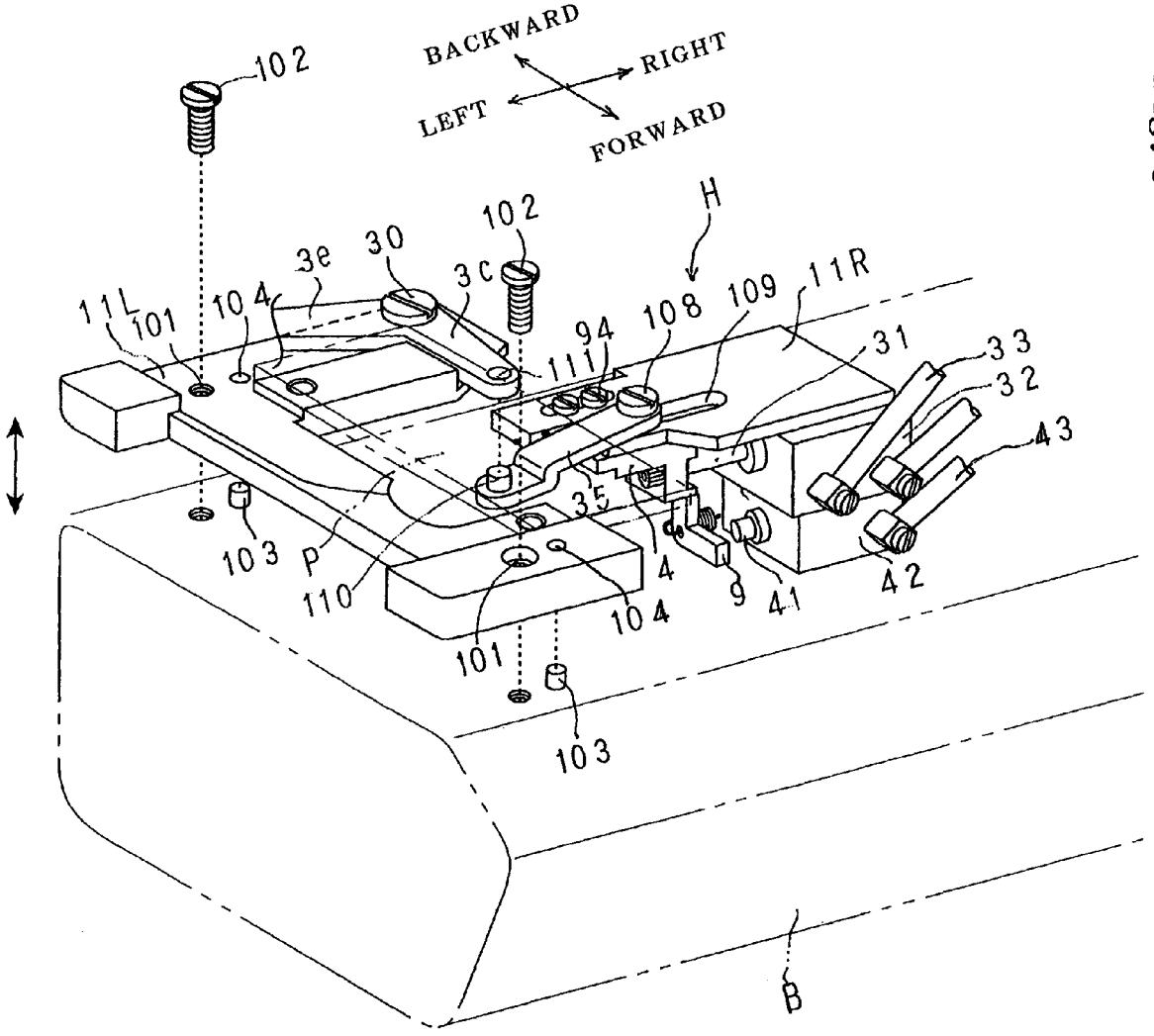
FIG. 3 is a perspective view showing a state in which part of the structure of the main parts of the seam ravel preventing apparatus is removed.
Figure 4:
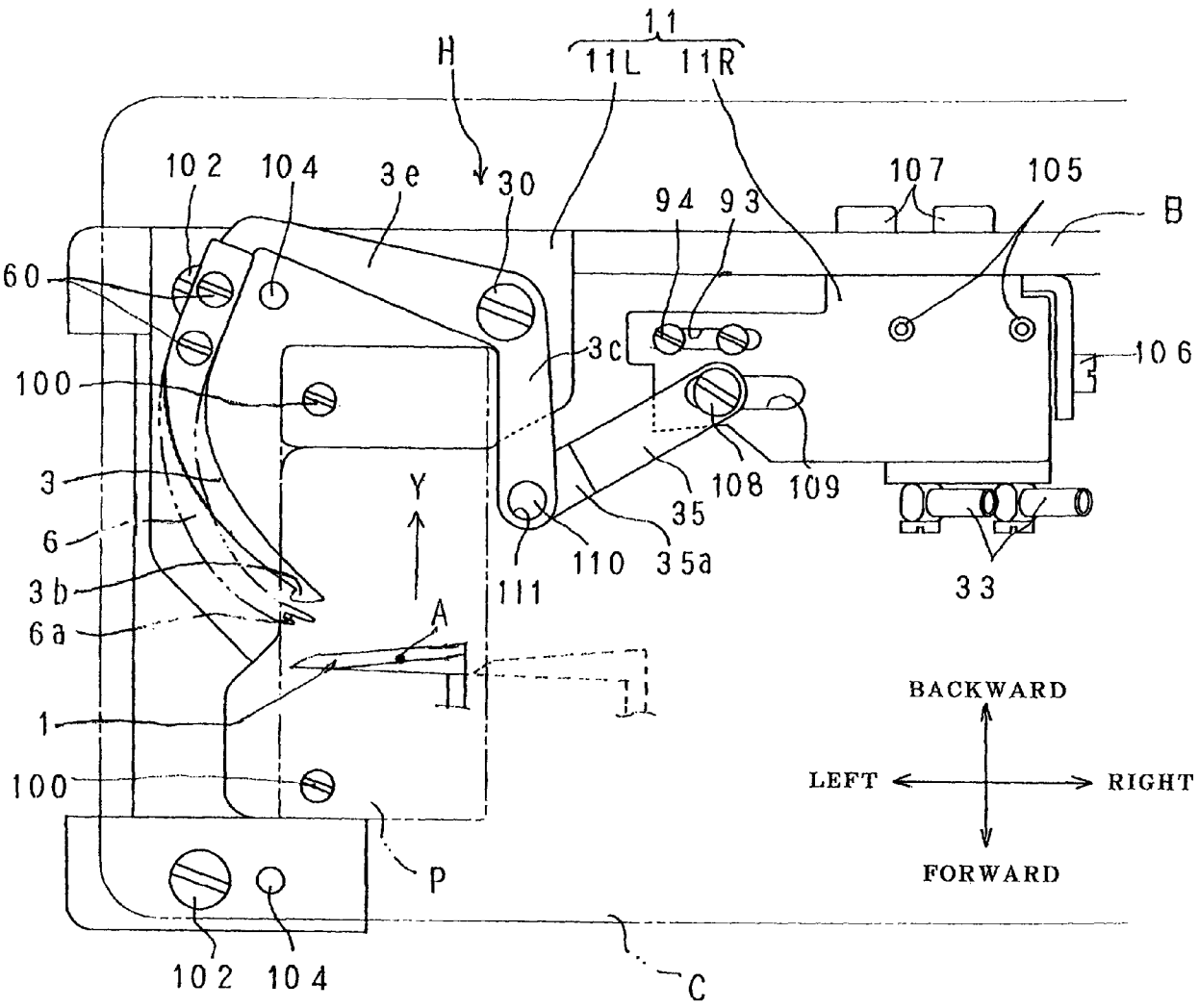
FIG. 4 is a plan view showing the structure of the main parts of the seam ravel preventing apparatus.

Several embodiments of the present invention are described below with reference to the accompanying drawings. FIG. 1 is the perspective view showing the general appearance of the horizontal tube type multi-thread chain stitch sewing machine according to the first embodiment of the present invention. FIGS. 2 and 3 are the perspective views showing the structure of the main parts of the seam ravel preventing apparatus included in the horizontal tube type multi-thread chain stitch sewing machine according to the first embodiment. FIG. 4 is the plan view showing the structure of the main parts of the seam ravel preventing apparatus. The following description is made using terms "left," "right," "forward," and "backward" indicated by arrows in FIGS. 2 to 4. That is, the term "forward" denotes the side near a sewing operator. The term "backward" denotes the side away from the sewing operator. The terms "left" and "right" denote the left and right, viewed from the front near the sewing operator.

As shown in FIG. 1, in the horizontal tube type multi-thread chain stitch sewing machine according to the first embodiment, a sewing machine arm C and a sewing machine bed B are extended substantially horizontally toward the left from an upper position and a lower position of a body section D, respectively. As shown in FIG. 4, the horizontal tube type multi-thread chain stitch sewing machine includes a looper 1, a single needle 2 (refer to FIGS. 11 to 17), a needle plate base 11 secured to an upper surface of the sewing machine bed B, a seam ravel preventing apparatus H incorporated into the needle plate base 11, and a needle plate P secured onto the needle plate base 11.

The needle 2 moves up and down, which is attached via a needle fixture 13 to a lower end portion of a needle bar 12 so as to be located on an extension line of the center of the needle bar 12 moving up and down interlockingly with the rotation of a sewing machine spindle (not shown) in the sewing machine arm C. Alphabetic character A in FIGS. 2 and 4 denotes a needle descent position (descent position) of the needle 2. The needle descent position A is set at a substantially middle portion of the needle plate P.

The looper 1 is installed in the sewing machine bed B, and moves forward and backward (left forward motion and right backward motion) in a direction substantially orthogonal to a vertical movement path of the needle 2 via the action of the looper driving mechanism (not shown). A solid line in FIG. 4 indicates a state in which the looper 1 has moved to a left forward position, and a broken line in FIG. 4 indicates a state in which the looper 1 has moved to a right backward position. As shown by the solid line in FIG. 4, a front end portion of the looper 1 at the left forward position extends leftward across the needle descent position A. As shown by the broken line in FIG. 4, the front end portion of the looper 1 at the right backward position is located rightward away from the needle descent position A.

The horizontal tube type multi-thread chain stitch sewing machine sews a fabric (not shown) set on the needle plate P by the up and down movements of the needle 2, and the left forward and right backward movements of the looper 1. The fabric is pressed against the needle plate P by a presser foot (not shown), and is fed in a direction of arrow Y in FIG. 4 by the action of a feed mechanism installed inside the sewing machine bed B. The feed mechanism includes feed dogs that repeat the following movements in which the feed dogs move in a backward direction while protruding from the needle plate P, and moves in a forward direction while sinking under, the needle plate P. The fabric is intermittently fed in the direction of arrow Y by the feed dogs.

The foregoing needle bar 12, the looper driving mechanism, and the feed mechanism are well known mechanisms which operate mutually synchronously by power transmission from the sewing machine spindle (not shown). The needle 2 holds a needle thread 20 (refer to FIGS. 11 to 17), and passes through the fabric and reaches below the needle plate P during the suspension of the feed of the fabric, and thereafter, the needle 2 ascends and passes through the fabric in an upward direction. The looper 1 holds a looper thread 10 (refer to FIGS. 11 to 17), and moves toward the left in synchronization with the needle 2 starting to ascend, thereby catching a loop 20*a* of the needle thread 20 formed below the needle plate P. The fabric is fed when the needle 2 ascends. The needle 2 descends while passing through the fed fabric, and catches the looper thread 10 held by the looper 1 retracted toward the right. The multi-thread chain stitch sewing machine forms multi-thread chain stitch seams on the fabric by repeating the forgoing actions.

The seam ravel preventing apparatus H included in the foregoing horizontal tube type multi-thread chain stitch sewing machine includes a needle thread holding mechanism, a stopper mechanism, a connecting rod 35 as a connecting member for interlockingly connecting a thread hanging hook 3 of the needle thread holding mechanism (described later) and a stopper member 4 of the stopper mechanism (described later), and a control section 8 (described later).

The needle thread holding mechanism includes the thread hanging hook 3, and a reciprocating type thread handling cylinder 32 as a hook actuator for drivingly swinging the thread hanging hook 3 around a vertical extending support shaft 30 between a standby position away from the looper 1 and a thread hooking position adjacent to the looper 1. The support shaft 30 as the swing center of the thread hanging hook 3 is disposed in the vicinity of a right back side corner of the needle plate P, and is supported on the needle plate base 11.

The thread hanging hook 3 has an arcuately curved shape, and is continuously formed so as to be folded forward at a front end portion of a support arm 3*e* extending leftward from the support shaft 30. A front end portion of the thread hanging hook 3 is faced onto the needle descent position A from the left back on a lower side of the needle plate P. An outward protruding hook portion 3*b* is formed at the front end portion of the thread hanging hook 3. The support arm 3*e* has an extended portion 3*c* extending forward from the support shaft 30, and one end of the connecting rod 35 is connected to a front end portion of the extended portion 3*c*.

As shown in FIGS. 5 to 8, the stopper mechanism is comprised of a stopper member 4 which is fixed via a set screw 36 to a front end portion (left end portion) of an output rod 31 of the thread handling cylinder 32, and is linearly reciprocatingly drivingly moved in a lateral direction due to expansion and contraction of the thread handling cylinder 32 by operating air supplied via an air tube 33; a swing lever 9 engageable with and disengageable from a part of the stopper member 4; a spring 91 which allows the swing lever 9 to be engaged with the part of the stopper member 4, and swingingly energizes in a direction in which the thread hanging hook 3 is located at the standby position; and a stopper cylinder 42 of single acting type (drivingly push-out type in the left direction) as a stopper actuator which forcibly disengages the swing lever 9 from the part of the stopper member 4 against the swing energizing force of the spring 91.

The output rod 41 of the stopper cylinder 42 is configured to swing the swing lever 9 counterclockwise against the swing energizing force of the spring 91 as the stopper cylinder 42 is drivingly pushed out toward the left by the operating air supplied via the air tube 43.

Figure 5:
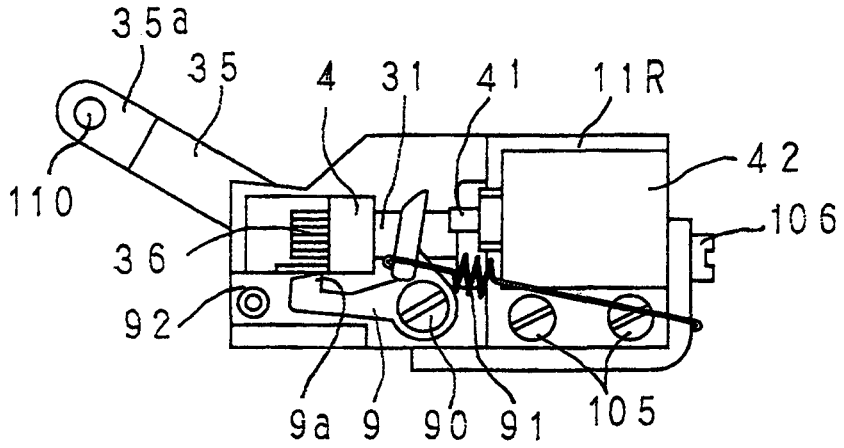
FIG. 5 is a bottom plan view of the main parts for explaining the structure of a stopper mechanism and a first action thereof in the seam ravel preventing apparatus.
Figure 6:
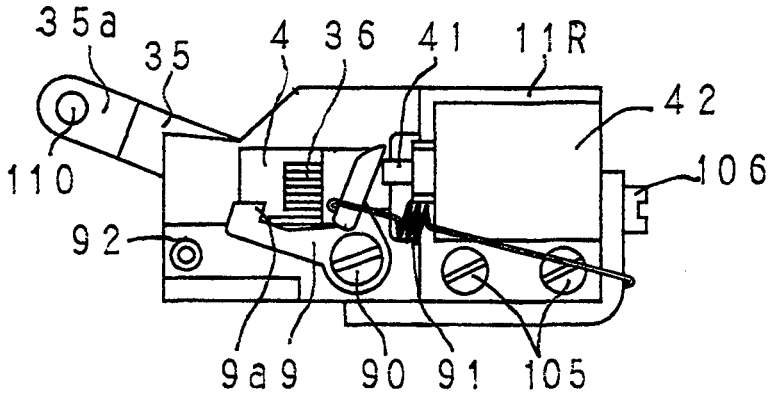
FIG. 6 is a bottom plan view of the main parts for explaining the structure of the stopper mechanism and a second action thereof.

The swing lever 9 is supported on the upper surface of a swing lever mount 92 so as to be swingable around the center of the vertically extending support shaft 90. The swing lever 9 has at a front end portion thereof an engaging claw 9*a* engageable with the part of the stopper member 4. During the time the stopper member 4 is drivingly moved toward the left by the expansion stroke of the thread handling cylinder 32, that is, during the time the thread hanging hook 3 is moved to the standby position, the swing lever 9 is contacted with a side part of the stopper member 4 by the energizing force of the spring 91, as shown in FIG. 5. During the time the stopper member 4 is drivingly moved toward the right by the contraction stroke of the thread handling cylinder 32, the swing lever 9 swings clockwise around the support shaft 90 by the energizing force of the spring 91, and the engaging claw 9*a* at the front end thereof enters a state of being engageable with the part of the stopper member 4, as shown in FIG. 6.

Figure 7:
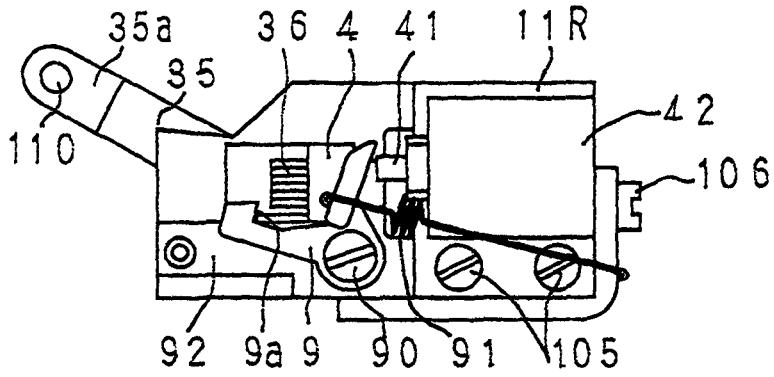
FIG. 7 is a bottom plan view of the main parts for explaining the structure of the stopper mechanism and a third action thereof.

As shown in FIG. 7, by allowing the contracted thread handling cylinder 32 to resume somewhat the expansion stroke, the engaging claw 9*a* at the front end of the swing lever 9 engages with the part of the stopper member 4, thereby suspending the leftward driving movement of the stopper member 4. In the state in which the stopper member 4 is so suspended, the thread hanging hook 3 moves via the connecting rod 35 to the hold position between the standby position and the thread hooking position, and stops there. At this time, the hook portion 3*b* at the front end of the thread hanging hook 3 moves from the thread hooking position shown in FIG. 4 (the needle descent position A) to the left back, and hooks the needle thread 20 and holds it at the hold position.

Figure 8:
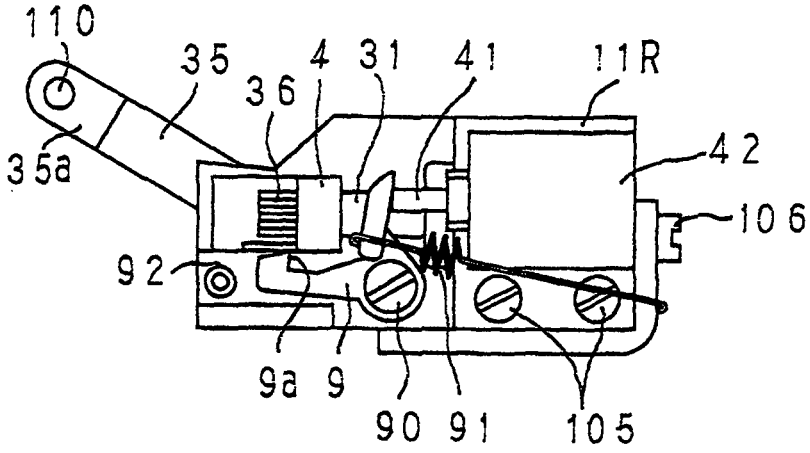
FIG. 8 is a bottom plan view of the main parts for explaining the structure of the stopper mechanism and a fourth action thereof.

Further, as shown in FIG. 8, the swing lever 9 is swung counterclockwise against the swing energizing force of the spring 91 by allowing the output rod 41 to be drivingly pushed out toward the left as the stopper cylinder 42 expands. This allows the engaging claw 9*a* at the front end of the swing lever 9 to be disengaged from the part of the stopper member 4, thereby releasing the suspension (temporary stop) of the stopper member 4. Consequently, the thread handling cylinder 32 is subjected to a maximum expansion stroke, and the thread hanging hook 3 is swingingly returned to the standby position via the connecting rod 35.

As described above, in the first embodiment, the thread hanging hook 3 of the needle thread holding mechanism swings into the standby position, the thread hooking position, and the hold position by the expansion and contraction strokes of the thread handling cylinder 32 and the stopper cylinder 42.

Figure 16:
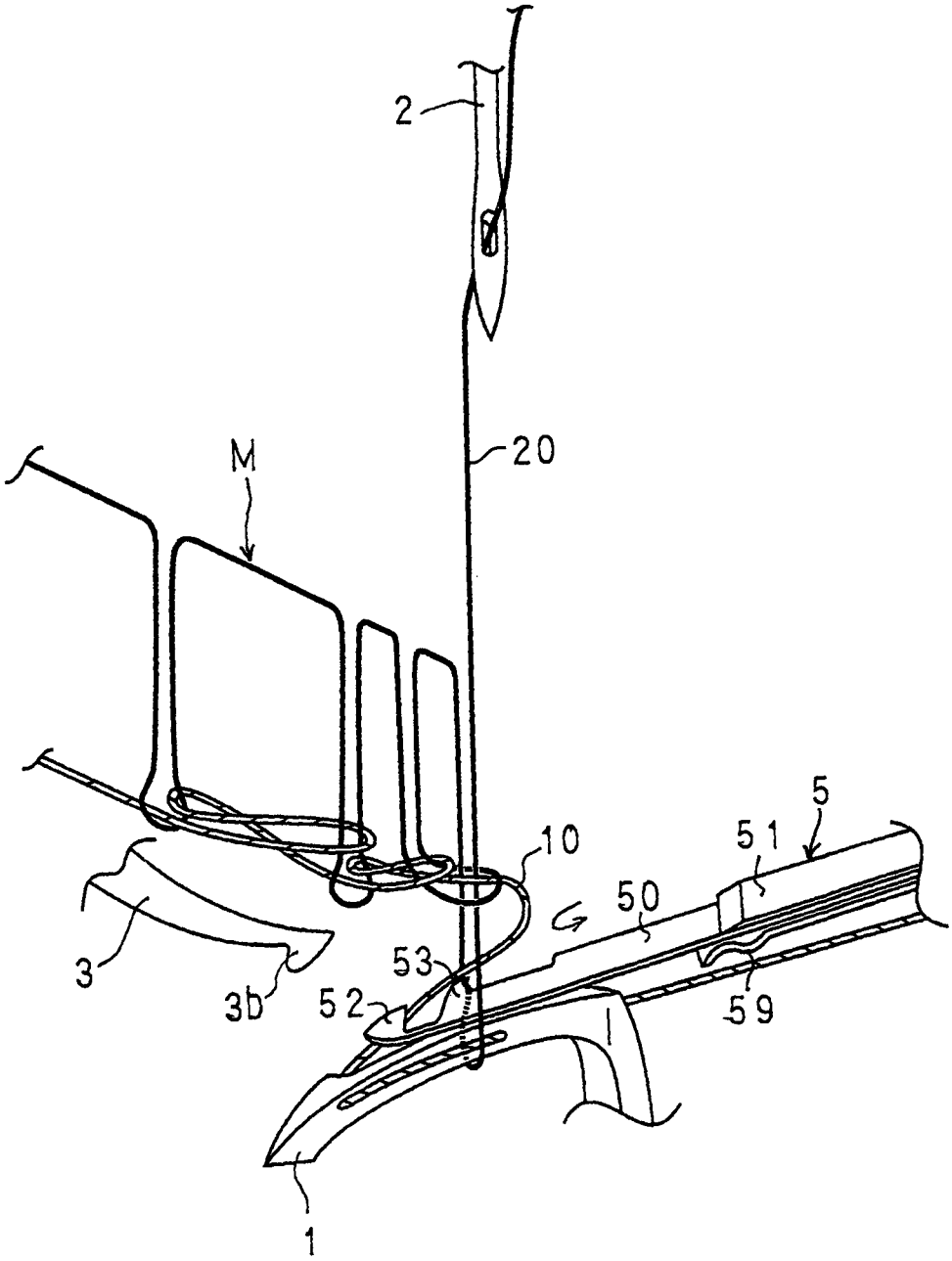
FIG. 16 is an explanatory drawing of a sixth seam ravel prevention action by the seam ravel preventing apparatus.
Figure 17:
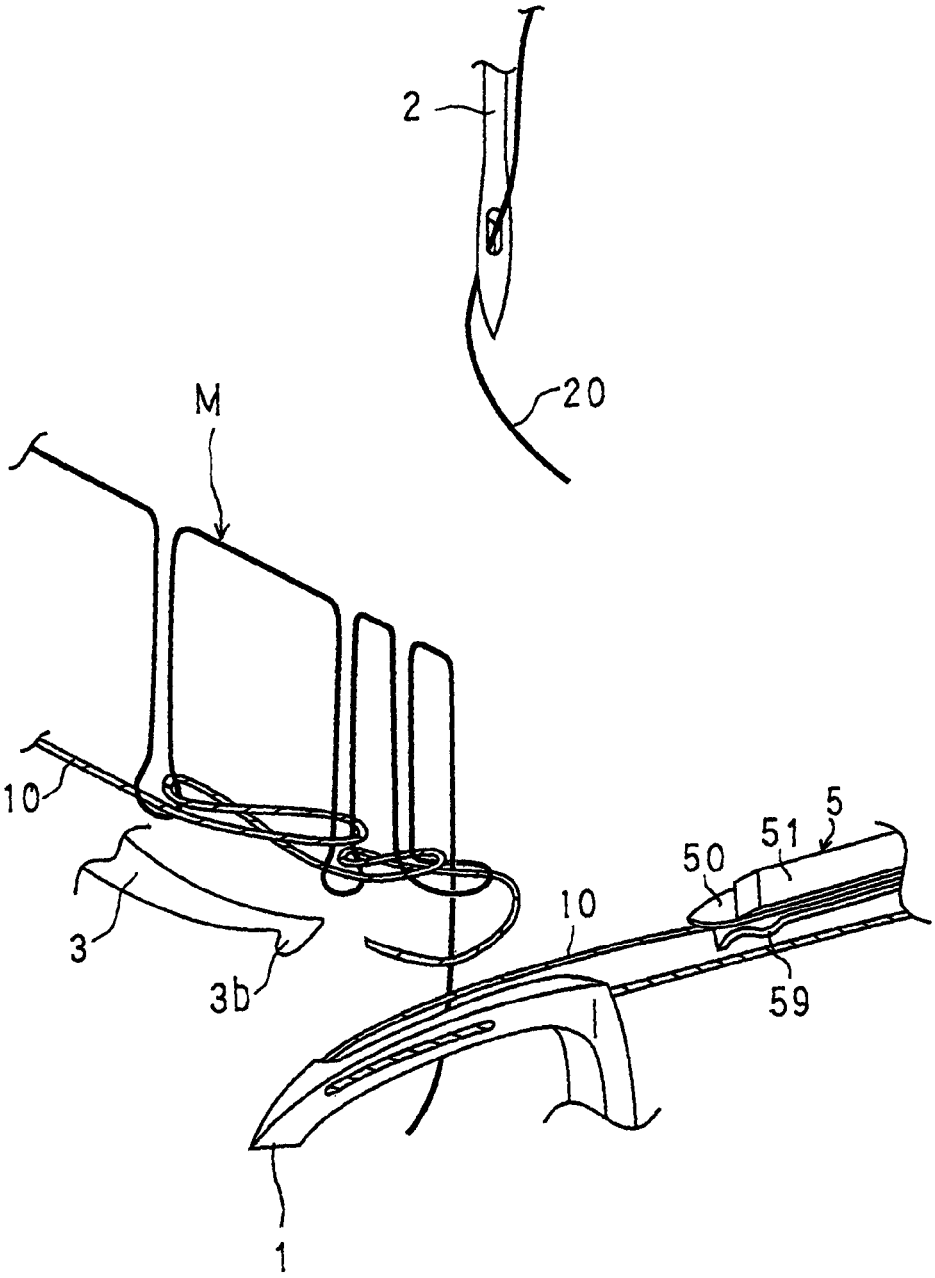
FIG. 17 is an explanatory drawing of a seventh seam ravel prevention action by the seam ravel preventing apparatus.

The horizontal tube type multi-thread chain stitch sewing machine in the first embodiment further includes a thread cutting mechanism 5 for cutting the needle thread 20 and the looper thread 10 after the sewing is terminated. As shown in FIGS. 16 and 17, the thread cutting mechanism 5 includes a thread cutting hook 50, a thread cutting knife 51, a leaf spring 59 for pressing the thread cutting hook 50 against a sliding contact part between itself and the thread cutting knife 51, and a thread cutting actuator 58 (refer to FIG. 9). The thread cutting hook 50 has at a front end portion thereof a first hook part 52 and a second hook part 53 which are protruded backward. The thread cutting mechanism 5 is well known and therefore, description and illustration of other detailed structures are omitted here.

The horizontal tube type multi-thread chain stitch sewing machine according to the first embodiment employs the structure in which the needle plate base 11 attached to the upper surface of the sewing machine bed B is divided into a left needle plate base 11L and a right needle plate base 11R, as shown in FIGS. 2 to 4. The needle plate P is detachably attached to the upper surface of the left needle plate base 11L via a set screw 100, and supports the support shaft 30 as the center of swing of the thread hanging hook 3 of the needle thread holding mechanism.

Screw holes 101 are formed at a plurality of front and rear portions (two portions) in the vicinity of the left end part in the left needle plate base 11L, specifically, at portions away from the attachment position of the needle plate P in the vicinity of the front end (left end) of the sewing machine arm C indicated by a virtual line in FIG. 4. The left needle plate base 11L is attached to the upper surface of the sewing machine bed B so as to permit fastening and unfastening (attachment and detachment) via set screw members 102 screwed into these screw holes 101.

Further, as shown in FIG. 3, the upper surface of the sewing machine bed B and the left needle plate base 11L are provided with knock pins 103 and pin holes 104 into which the knock pins 103 fit, at positions away from two fastening positions via the set screw members 102. The pin holes 104 are inserted from above into and engaged with the knock pins 103, thereby positioning the left needle plate base 11L at predetermined position and posture with respect to the sewing machine bed B. In this state, the set screw members 102 are screwed into the screw holes 101, thereby allowing the left needle plate base 11L to be fastened against the upper surface of the sewing machine bed B.

The first embodiment has described and illustrated one in which the knock pins 103 protrude upward from the upper surface of the sewing machine bed B, and the pin holes 104 are formed in the left needle plate base 11L. Alternatively, the knock pins 103 may protrude downward from the lower surface of the left needle plate base 11L, and the pin holes 104 may be formed in the upper surface of the sewing machine bed B.

On the other hand, the right needle plate base 11R constitutes a cylinder attachment base for supporting the thread handling cylinder 32 and the stopper cylinder 42 (hereinafter the right needle plate base 11R is referred to as the cylinder attachment base). The foregoing stopper mechanism is disposed below the cylinder attachment base 11R. To be specific, as shown in FIGS. 5 to 8, the thread handling cylinder 32 is fixedly supported on the lower surface of the cylinder attachment base 11R via an attachment screw 105. The stopper cylinder 42 is disposed below the thread handling cylinder 32 in a two-stage fashion, and the stopper cylinder 42 is fixedly supported on the cylinder attachment base 11R via an attachment screw 106.

The cylinder attachment base 11R is installed in a fixed state to a side surface of the sewing machine bed B via set screw members 107. The phrase "fixed state" denotes the state in which the seam ravel preventing apparatus H is fixed to a predetermined position by fastening the set screw members 107 when the apparatus H is installed in the sewing machine bed B, and is fixed at a predetermined installation position after the installation without performing any positional adjustment or the like.

One end (right end) portion of the connecting rod 35 is rotatably connected to the stopper member 4 in the stopper mechanism by a pin screw 108. In a certain part of the cylinder attachment base 11R which corresponds to a connecting part between the one end of the connecting rod 35 and the stopper member 4 by the pin screw 108, a long groove 109 that is long in a lateral direction is formed so as to allow for a linear reciprocating movement of the stopper member 4 that linearly reciprocates in the lateral direction in response to the expansion and contraction of the thread handling cylinder 32.

A connection end portion 35*a* of the other end of the connecting rod 35, which is connected to an extended part 3*c* connected to the thread hanging hook 3, is bent downward by an amount of a substantial thickness of the extended part 3*c*. A pin 110 is protruded upward from the connection end portion 35*a* of the downward bent connecting rod 35. On the other hand, the extended part 3*c* is provided with a connecting hole 111 that is insertable into the pin 110 from above the pin 110 and is drawable in an upward direction.

This eliminates the need to perform an operation for fixedly connecting the connecting rod 35 and the extended part 3*c*, for example, releasing an interlocking state between the two by unfastening a set screw or the like, when the left needle plate base 11L is removed from the sewing machine bed B by unfixing it from the sewing machine bed B. That is, the connecting hole 111 of the extended part 3*c* can be drawn upward from the pin 110, and the interlocking state between the connecting rod 35 and the extended part 3*c* (the thread hanging hook 3) can be released only by raising the left needle plate base 11L. Also, when attaching the left needle plate base 11L to the sewing machine bed B, only by shifting the left needle plate base 11L from above toward the sewing machine bed B, the connecting hole 111 is inserted into the pin 110 from above, thereby allowing the connecting rod 35 and the extended part 3*c* (thread hanging hook 3) to return to the interlocking state. The connection end portion 35*a* of the connecting rod 35 needs not necessarily be bent downward. That is, the connecting rod 35 may have a plate shape that is flat throughout its entire length.

A swing lever attachment base 92, which supports the swing lever 9 in the stopper mechanism so as to be swingable around the vertically extending support shaft 90, is attached to the cylinder attachment base 11R so as to permit lateral position adjustment via a long hole 93 being long in a lateral direction and a set screw 94. Hence, even after the cylinder attachment base 11R is installed in the fixed state into the sewing machine bed B via the screw member 107, timing that the looper 1 slips through the needle thread loop 20*a* held by the thread hanging hook 3 can be optionally adjusted by performing the lateral position adjustment of the swing lever attachment base 92 with respect to the cylinder attachment base 11R. This ensures the selflooping for the seam ravel prevention.

In the horizontal tube type multi-thread chain stitch sewing machine of the first embodiment with the seam ravel preventing apparatus H employing the structure in which the needle plate base 11 is divided into the two sections of the left needle plate base 11L and the right needle plate base 11R, when the seam ravel preventing apparatus H is installed into the sewing machine bed B, the left needle plate base 11L and the right cylinder attachment base 11R, which are obtained by dividing the needle plate base 11 into right and left sections, can be individually attached to the sewing machine bed B. Hence, as compared with handling of the single laterally long and large needle plate in which these two left and right needle plate bases 11L and 11R are integrated together, the attachment (installation) operation of the entirety of the seam ravel preventing apparatus H with respect to the sewing machine bed B can be easily carried out with less effort.

Additionally, if after the needle plate base 11 (the left needle plate base 11L and the right cylinder attachment base 11R) is installed into the sewing machine bed B, it becomes necessary to adjust stitch performation by correcting the position and motion loci of the components for performing the sewing action which are located below the needle plate base 11 and are stored inside the sewing machine bed B, such as the looper 1 and actuating members therefor, or it becomes necessary to perform maintenance, such as mending and replacement, on various types of components located below the needle plate base 11 and stored inside the sewing machine bed B, it is unnecessary to remove the cylinder attachment base 11R by which the thread handling cylinder 32 and the stopper cylinder 43 respectively having the air tubes 33 and 43 attached thereto are strongly fixedly supported during the installation. A sufficiently wide operating space can be ensured only by unfixing and removing only the left needle plate base 11L from the sewing machine bed B.

Figure 9:
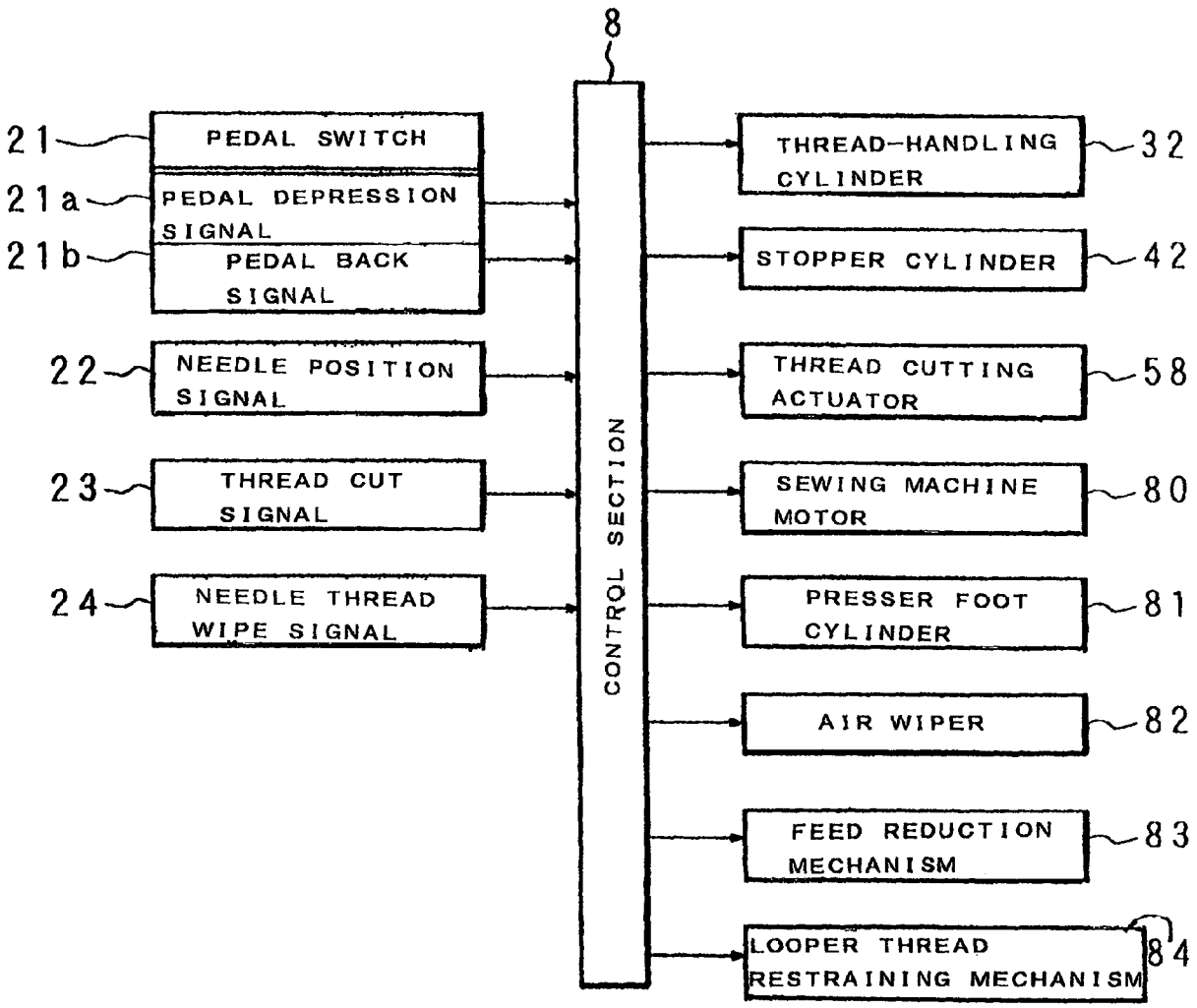
FIG. 9 is a block diagram showing the configuration of a control system of the horizontal tube type multi-thread chain stitch sewing machine of the first embodiment, including the seam ravel preventing apparatus.

FIG. 9 is the block diagram showing the configuration of the control system of the horizontal tube type multi-thread chain stitch sewing machine of the first embodiment, including the seam ravel preventing apparatus H as described above.

A pedal depressing signal 21*a* and a pedal back signal 21*b* generated by a pedal switch 21, a needle position signal 22 generated when the needle 2 is in the vicinity of a top dead center, a thread cutting signal 23, and a needle thread wiping signal 24 are respectively inputted to the control section 8 of the multi-thread chain stitch sewing machine.

On the other hand, the control section 8 outputs action control signals to the thread handling cylinder 32, the stopper cylinder 42, and the thread cutting actuator 58, respectively. The thread hanging hook 3 and the looper thread holder 6 act as previously described according to the action control signals outputted from the control section 8 to the thread handling cylinder 32 and the stopper cylinder 42, and the thread cutting actuator 58 of the thread cutting mechanism 5 expands and contracts according to the thread cutting signal 23 outputted from the control section 8.

The control section 8 also outputs action control signals respectively to a sewing machine motor 80 as a driving source of the sewing machine spindle, a presser foot cylinder 81 for moving up and down a presser foot for pressing the fabric, an air wiper 82 for wiping up the needle thread 20 to be cut as described later, a feed reducing mechanism 83 for adjusting a fabric feeding rate, and a looper-thread restraining mechanism 84 for restraining the feed of the looper thread 10 to the looper 1.

The feed reducing mechanism 83 reduces the fabric feed rate by changing a mode of operation of the feed dogs in the feed mechanism. For example, time period during which the feed dogs act on the fabric on the needle plate P is reduced by inclining action passages of the feed dogs with respect to the needle plate P so as to reduce time period during which it protrudes upward from the needle plate P, or a unit feed pitch by the feed dogs is reduced by changing a length of a lever for cyclically operating the feed dogs. The feed reducing mechanism 83 of this type is well known, and therefore detailed illustration and description thereof are omitted here.

The looper-thread restraining mechanism 84 includes a thread tension disc for squeezing a mid-portion of the looper thread 10 to be fed to the looper 1, and an actuator that operates to increase or decrease strength to squeeze the looper thread by the thread tension disc. The strength to squeeze the looper thread by the thread tension disc is enhanced to increase resistance applied to the looper thread 10, thereby restraining the feed of the looper thread 10. The looper-thread restraining mechanism 84 of this type is well known, and therefore detailed illustration and description thereof are omitted here.

At the end of the sewing for forming the multi-thread chain stitch seams, the control section 8 executes a seam ravel prevention operation on the multi-thread chain stitch seams by allowing the thread hanging hook 3 to act in association with the sewing machine motor 80, the presser foot cylinder 81, the air wiper 82, the feed reducing mechanism 83, and the looper-thread restraining mechanism 84.

Figure 10:
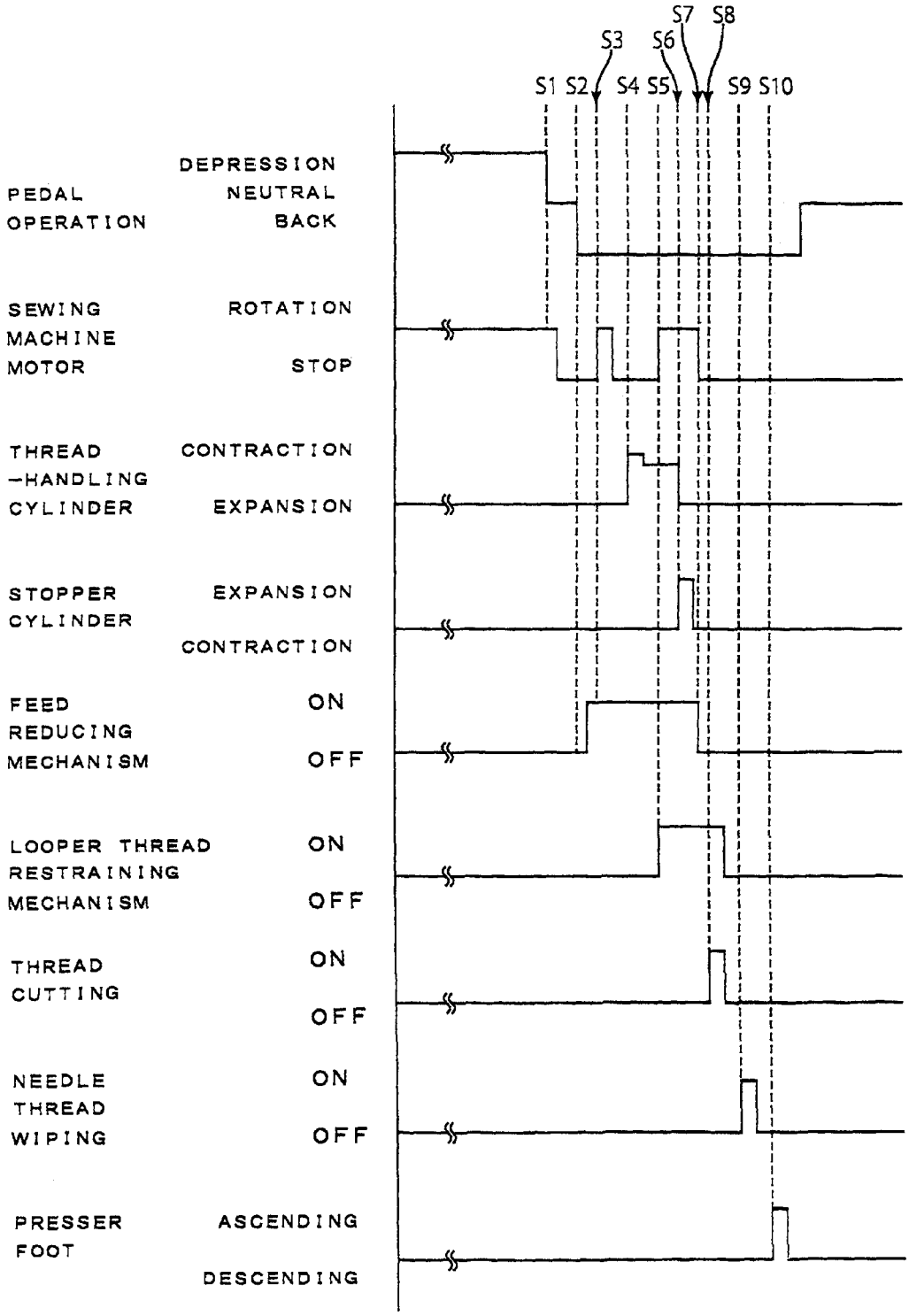
FIG. 10 is a time chart for explaining time series operation contents of a control section for the seam ravel prevention.

FIG. 10 is the time chart showing time series operation contents of the control section 8 for the purpose of the seam ravel prevention. The control section 8 is a computer including a CPU, a ROM, and a RAM. The seam ravel prevention operation according to the time chart shown in FIG. 10 is executed by a series of operations of the CPU according to a control program stored in the ROM.

FIGS. 11 to 17 are the explanatory drawings of the seam ravel prevention operation by the seam ravel preventing apparatus H in the horizontal tube type multi-thread chain stitch sewing machine, and show operation statuses of the thread hanging hook 3 and the thread cutting hook 50 generated by the operation of the control section 8 according to the time chart of FIG. 10.

When the sewing operator using the sewing machine terminates the normal sewing, the operator stops a depressing operation of a pedal for driving the sewing machine, and then performs the seam ravel prevention operation. In this case, the operator performs a pedal back operation of the pedal. The pedal switch 21, attached to the pedal, outputs the pedal depression signal 21*a* during the pedal depression operation, and outputs the pedal back signal 21*b* in response to the pedal back operation.

When the normal sewing is terminated, and the pedal for driving the sewing machine is returned from a depressed state to a neutral state at time SI in FIG. 10, namely, when neither the pedal depression signal 21*a* nor the pedal back signal 21*b* is outputted from the pedal switch 21, the control section 8 outputs a stop command to the sewing machine motor 80 by referring to the needle position signal given to the input side. Consequently, the sewing machine is suspended in a state in which the needle 2 is positioned in the vicinity of the top dead point and the looper 1 has moved toward the left.

Thereafter, the control section 8 stands by until the pedal is subjected to the pedal back operation. When the pedal back operation is performed, and the pedal back signal 21*b* is inputted to the input side at time S2 in FIG. 10, the control section 8 reduces the feed rate of the fabric than that during the normal sewing, for example, decreases the unit feed pitch of the feed dogs by firstly providing an action start command to the feed-reducing mechanism 83 at time S3, and then starts the seam ravel prevention operation as described below. The time (S3) that the control section 8 starts the feed of the lower feed rate of the fabric by the feed dogs in the feed-reducing mechanism 83 is set at a certain time prior to one and a half stitches or more before the needle thread loop 20*a* is positioned closer to the forward movement end of the looper 1 than the descent position of the needle 2 by the thread hanging hook 3.

When the pedal depression signal 21*a* is inputted again from the pedal switch 21, the control section 8 returns to the normal sewing operation. Therefore, the sewing operator can continue the normal sewing by performing the pedal depressing operation again. In FIG. 10, though the neutral state is maintained during a period of time between SI and S2, maintaining the neutral state is not necessarily required. The pedal operation at the end of the normal sewing may be continuously shifted from the pedal depression state to the pedal back state. In this case, when passing through the neutral position in the shift progress, it enters a non-signal state in which neither the pedal depression signal 21*a* nor the pedal back signal 21*b* is outputted. Using the non-signal state as a trigger, the control section 8 starts the seam ravel prevention operation after achieving the state in which the needle 2 ascends to near the top dead point and the looper 1 is moved toward the left, as described above.

Also in the time chart of FIG. 10, though the pedal back operation at time S2 is continued during execution of the seam ravel prevention operation described later, it is unnecessary to continue the pedal back operation until the seam ravel prevention operation is terminated, and the seam ravel prevention operation is continuously executed by the operation of the control section 8 even after the input of the pedal back signal 21*b* is discontinued.

Figure 11:
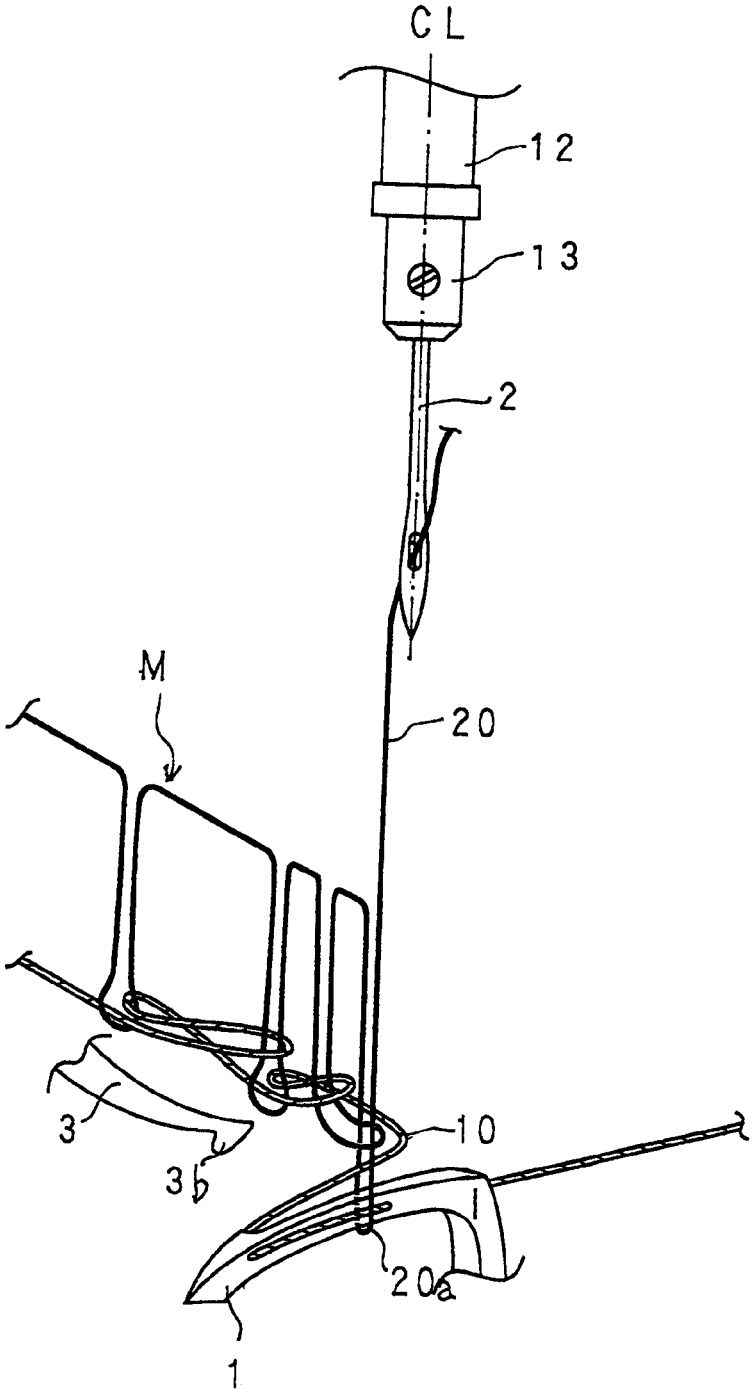
FIG. 11 is an explanatory drawing of a first seam ravel prevention action by the seam ravel preventing apparatus.
Figure 27:
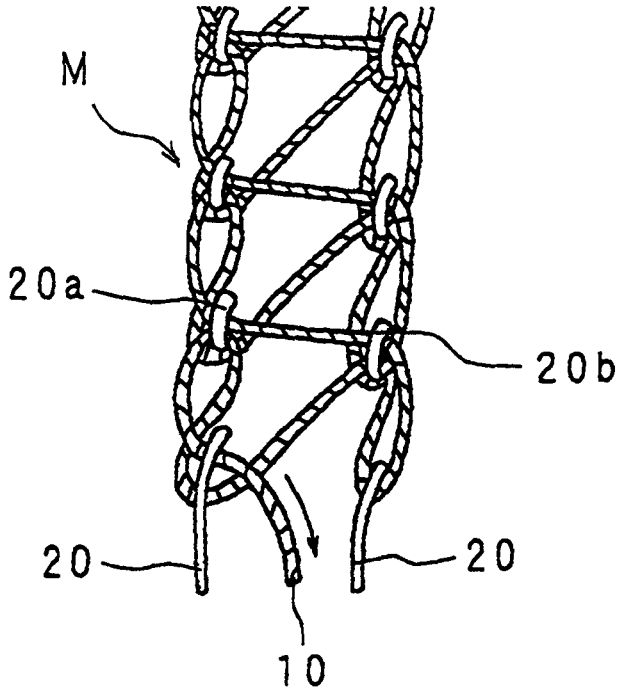
FIG. 27 is a bottom plan view roughly showing a seam structure at the end of sewing of general multi-thread chain stitches.
Figure 28:
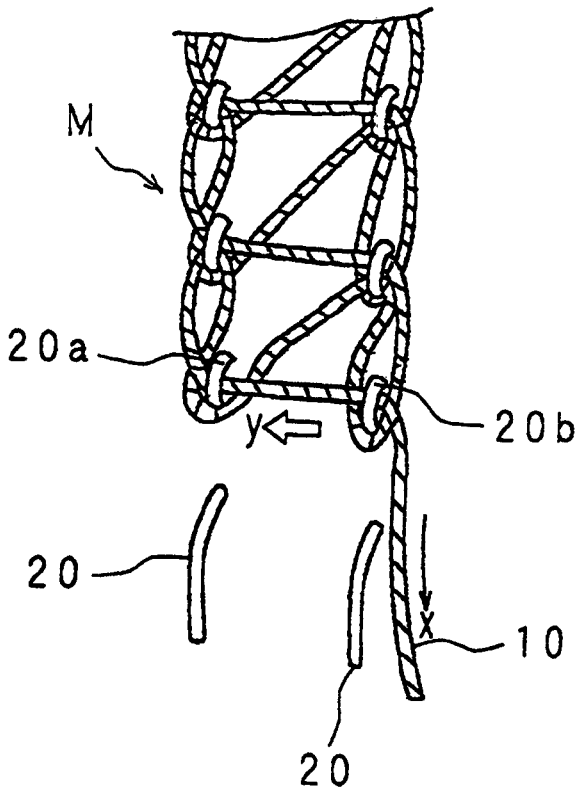
FIG. 28 is a bottom plan view roughly showing a seam structure at the end of sewing as proposed by prior art.
Figure 29:
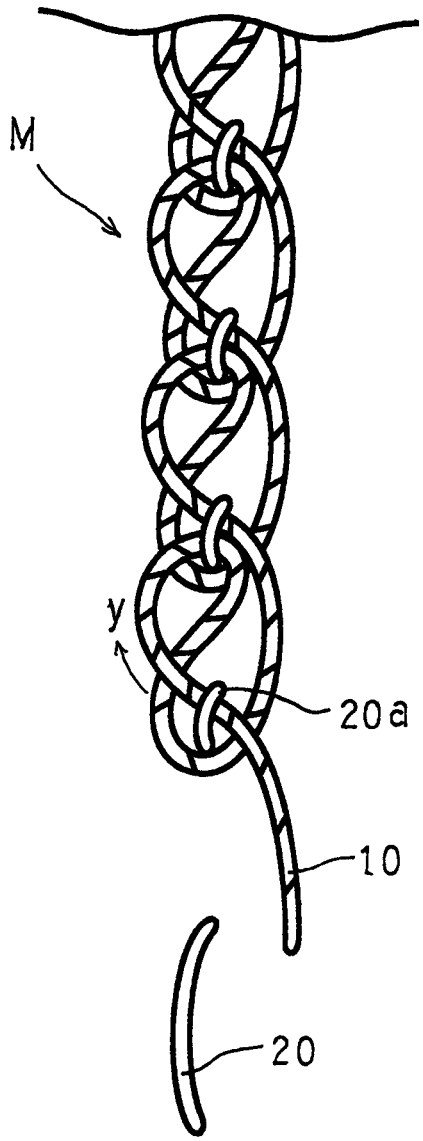
FIG. 29 is a bottom plan view roughly showing a seam structure at the end of sewing when the prior art is applied to multi-thread chain stitch sewing using a single needle.

FIG. 11 shows the states of the needle 2, the looper 1 and the thread hanging hook 3 at the start of the seam ravel prevention operation. The needle 2 is passed through in the upward direction the fabric having the multi-thread chain stitch seams M formed thereon, by the single needle thread 20 and the single looper thread 10, and the needle 2 is located above the fabric. The looper 1 has moved toward the left below the fabric, and is in a state of catching the needle thread loop 20*a* formed by the needle 2. When the needle thread 20 and the looper thread 10 are cut in this state, a sewing end portion as shown in FIG. 27 is formed.

After starting the seam ravel prevention operation, the control section 8 firstly provides an operation command to the thread handling cylinder 32 on the output side at time S4 in FIG. 10. In response to this command, the thread handling cylinder 32 moves from a state of expansion shown in FIG. 5 to a state of contraction shown in FIG. 6, and the stopper member 4 is drivingly moved toward the right. Accordingly, the thread hanging hook 3 moves from the standby position to the thread hooking position by swinging around the support shaft 30 via the stopper member 4 and the connecting rod 35. At this time, the hook portion 3*b* at the front end of the thread hanging hook 3 hooks the needle thread loop 20*a*, and the swing lever 9 in the stopper mechanism swings clockwise around the support shaft 90 by the energizing force of the spring 91, and the engaging claw 9*a* at the front end thereof enters the state of being engageable with the part of the stopper member 4.

Immediately thereafter, the control section 8 provides an operation command to the thread handling cylinder 32, so that the thread handling cylinder 32 expands somewhat from the state shown in FIG. 6 to the state shown in FIG. 7, and the stopper member 4 is linearly drivingly moved toward the left. During the slight expansion of the thread handling cylinder 32, the engaging claw 9*a* at the front end of the swing lever 9 engages with the part of the stopper member 4, thereby suspending a leftward driving movement of the stopper member 4. In the state in which the leftward driving movement of the stopper member 4 is suspended, as shown in FIG. 12, the thread hanging hook 3 moves via the connecting rod 35 to the hold position between the standby position and thread hooking position, and stops there and holds the left needle thread loop 20*a* at the hold position.

After the thread hanging hook 3 is thus moved to and stopped at the hold position, the control section 8 provides operation commands respectively to the sewing machine motor 80 and the looper thread restraining mechanism 84 at time S5 in FIG. 10. These operation commands are provided by referring to the needle position signal 22 in a period of time during which the needle 2 moves down and moves up again to the position near the top dead point. Accordingly, the sewing action for one stitch on the fabric is carried out. The sewing for the one stitch is carried out at a lower feed rate than during the normal sewing by the action of the feed-reducing mechanism 83. The sewing for the one stitch is also carried out in a state in which the feed of the looper thread 10 to the looper 1 is restrained by the action of the looper thread restricting mechanism 84. This improves tightness of the looper thread 10 at the end of the sewing, thereby enhancing the seam ravel prevention effect described later.

Figure 12:
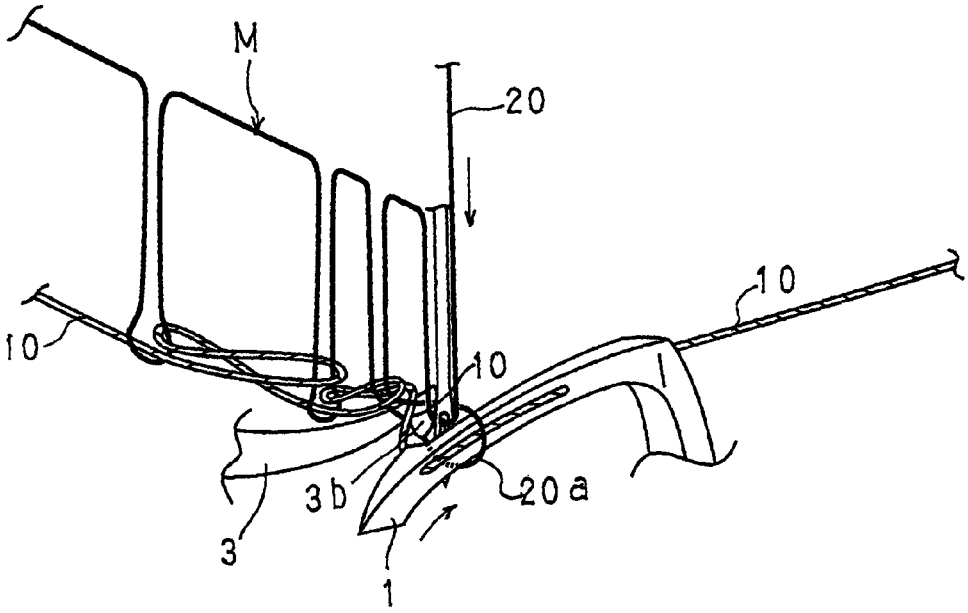
FIG. 12 is an explanatory drawing of a second seam ravel prevention action by the seam ravel preventing apparatus.

As shown in FIG. 12, the thread hanging hook 3 continues the holding of the needle thread 20 until the fabric feed is completed, and the needle 2 passes through the needle thread loop 20*a* held by the thread hanging hook 3 and catches the needle thread loop 20*a*. At this time, the looper thread 10 is located across the rear of the needle 2, as shown in FIG. 12.

Figure 13:
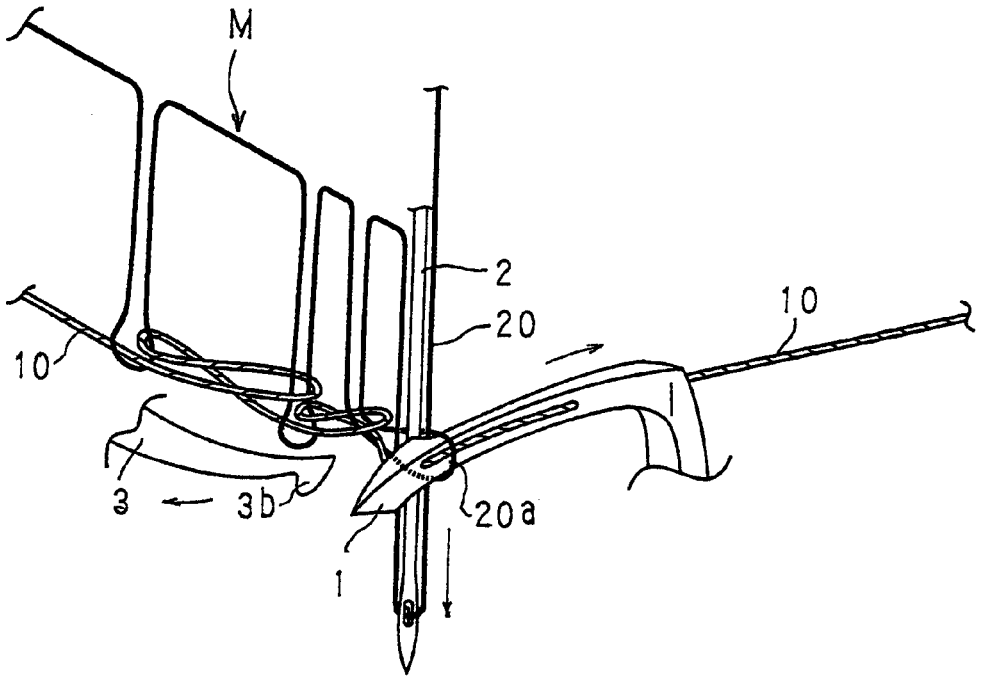
FIG. 13 is an explanatory drawing of a third seam ravel prevention action by the seam ravel preventing apparatus.

At the time the needle 2 catches the needle thread loop 20*a*, namely, immediately after time S6 in FIG. 10, the control section 8 allows the stopper cylinder 42 of the stopper mechanism to expand by providing an operation command to the stopper cylinder 42. Accordingly, the output rod 41 is drivingly pushed out toward the left. Consequently, as shown in FIG. 8, the swing lever 9 is swung counter-clockwise against the swing energizing force of the spring 91, and the engaging claw 9*a* at the front end of the swing lever 9 is disengaged from the part of the stopper member 4, thus permitting release of the suspension (temporary stop) of the stopper member 4. Upon the release of the suspension of the stopper member 4, the thread handling cylinder 32 is expanded to its maximum at time S6. Consequently, as shown in FIG. 13, the thread hanging hook 3 performs a return movement from the hold position to the standby position by swinging around the support shaft 30 via the stopper member 4 and the connecting rod 35, and then releases the holding of the needle thread loop 20*a*.

Figure 14:
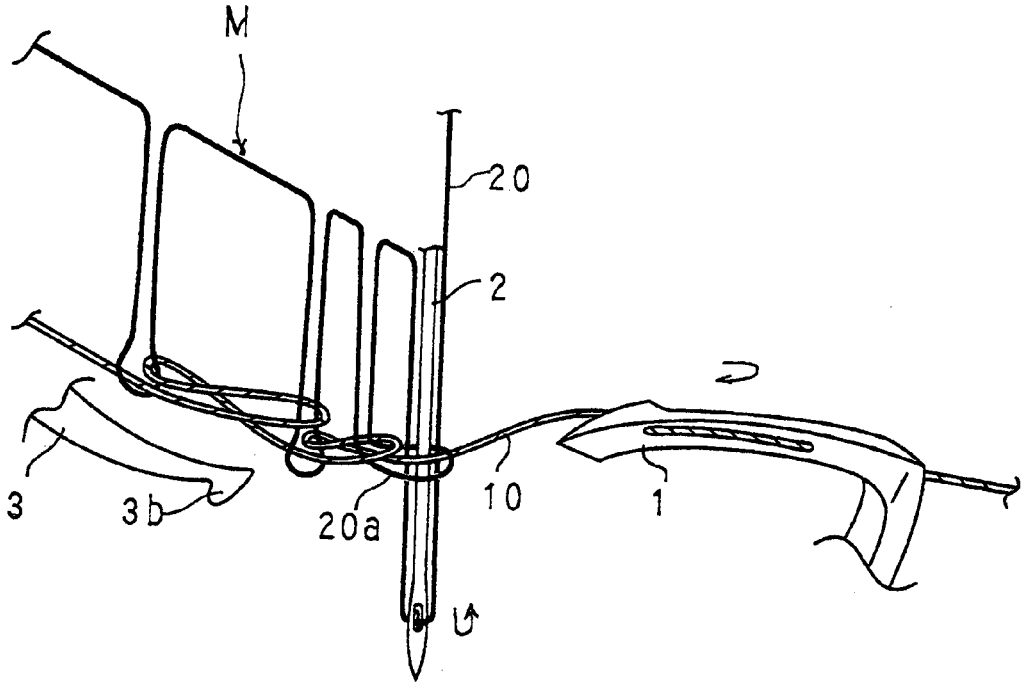
FIG. 14 is an explanatory drawing of a fourth seam ravel prevention action by the seam ravel preventing apparatus.

The looper 1 then performs a right retraction action as the needle 2 moves down, and slips through the caught needle thread loop 20*a*. By the looper 1 slipping therethrough, as shown in FIG. 14, the needle 2 enters a state of catching the looper thread 10 similarly during the normal sewing.

Figure 15:
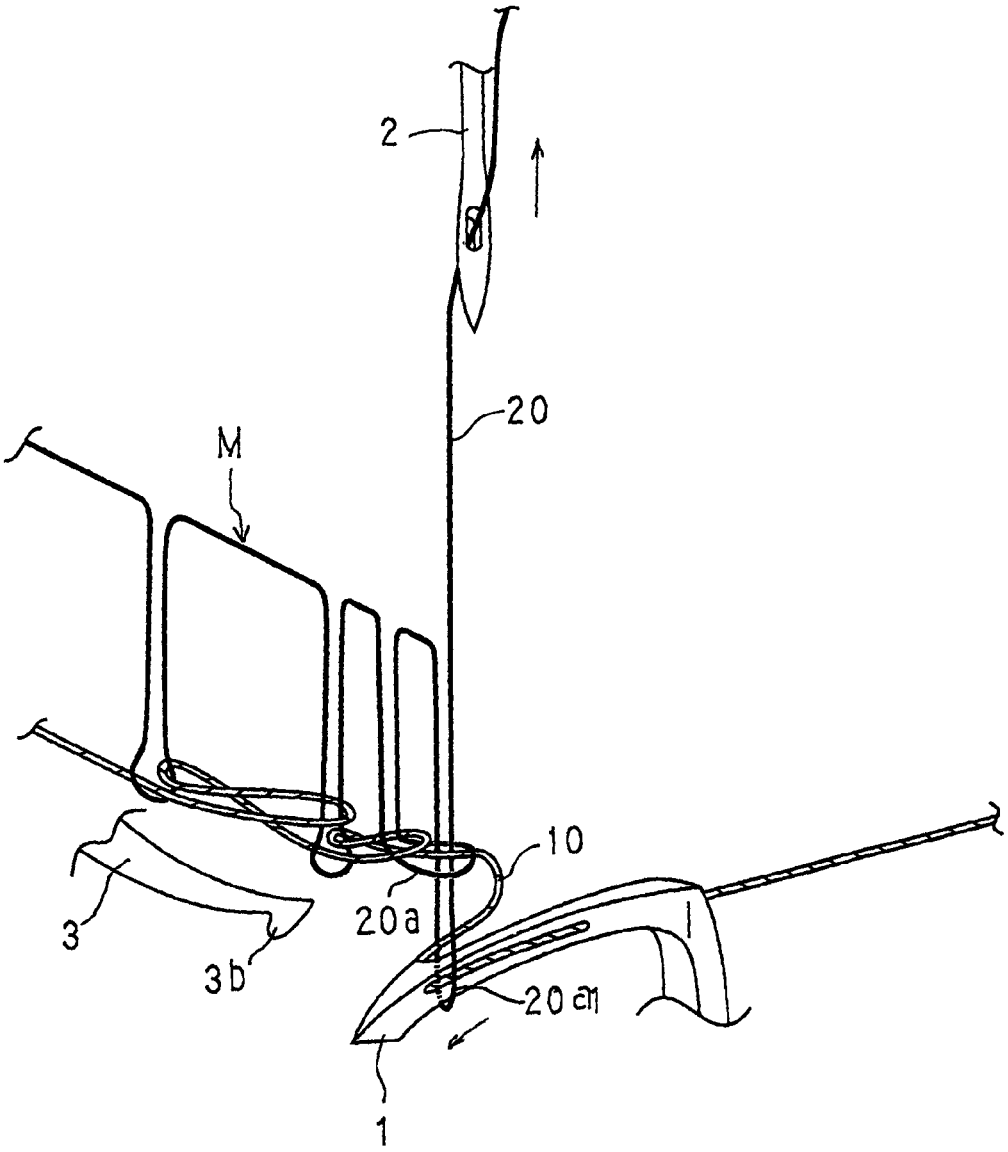
FIG. 15 is an explanatory drawing of a fifth seam ravel prevention action by the seam ravel preventing apparatus.

In this state, the looper 1 performs a left forward movement, and the needle 2 performs an upward movement. As shown in FIG. 15, the looper 1 performing the left forward movement catches a needle thread loop 20*al*, and the needle 2 performing the upward movement passes through the fabric in the upward direction. Accordingly, the needle thread 20 caught by the looper 1 performs looping the previously formed needle thread loop 20*a* with the needle thread 20, namely so-called selflooping.

After the sewing action for the one stitch, it is finished in a state in which the needle 2 is moved to the vicinity of the top dead point, and the looper 1 reaches the vicinity of the leftward movement end. Thereafter, the control section 8 stops the action of the feed-reducing mechanism 83 at time of S7 in FIG. 10, and holds this state until the thread cutting signal 23 is applied thereto. When the thread cutting signal 23 is applied at time S8 in FIG. 10, the control section 8 allows the thread cutting actuator 58 of the thread cutting mechanism 5 to perform a predetermined operation by providing an operation command to the thread cutting actuator 58. Accordingly, the thread hanging hook 50 reaches a forward movement end along the upper part of the looper 1, as shown in FIG. 16. At this time, the first hook part 52 at the front end of the thread cutting hook 50 passes through the needle thread loop 20*a* held by the looper 1 to the left side of the looper thread 10 extending from the front end of the looper 1 to the fabric, and the second hook part 53 is opposed to the needle thread 20 from the left side thereof.

Subsequently, the thread cutting hook 50 located at the forward movement end performs a right backward movement. At this time, the first hook part 52 catches the looper thread 10, and the second hook part 53 catches the needle thread 20. The looper thread 10 and the needle thread 20 caught in this manner are then pulled to a retraction end of the thread cutting hook 50, and are cut by being brought into sliding contact with a cutting edge at the front end of the thread cutting knife 51, as shown in FIG. 17. An end portion of the cut looper thread 10 is held in sandwich fashion between the thread cutting hook 50 and the leaf spring 59 at a position closer to the looper 1 than a cutting position.

The looper-thread restraining mechanism 84 continues to operate and applies predetermined tension to the looper thread 10 extending from the front end of the looper 1 to the fabric, until the foregoing thread cutting operation is terminated. This ensures that the first hook part 52 at the front end of the thread cutting hook 50 catches and cuts the non-loose looper thread 10.

After the foregoing cutting operation, the control section 8 stands by until the needle thread wiping signal 24 is inputted thereto. When the needle thread wiping signal 24 is inputted thereto at time S9 in FIG. 10, the control section 8 allows the air wiper 82 to operate by outputting an operation command to the air wiper 82. The air wiper 82 blows out air and blows up the cut end portion of the needle thread 20 that is continuous with the needle 2. Thereafter, the control section 8 allows the presser foot cylinder 81 to operate to raise the presser foot for pressing the fabric by outputting an operation command to the presser foot cylinder 81 at time S10 in FIG. 10, thereby terminating the sequence of the seam ravel prevention operation.

Figure 18:
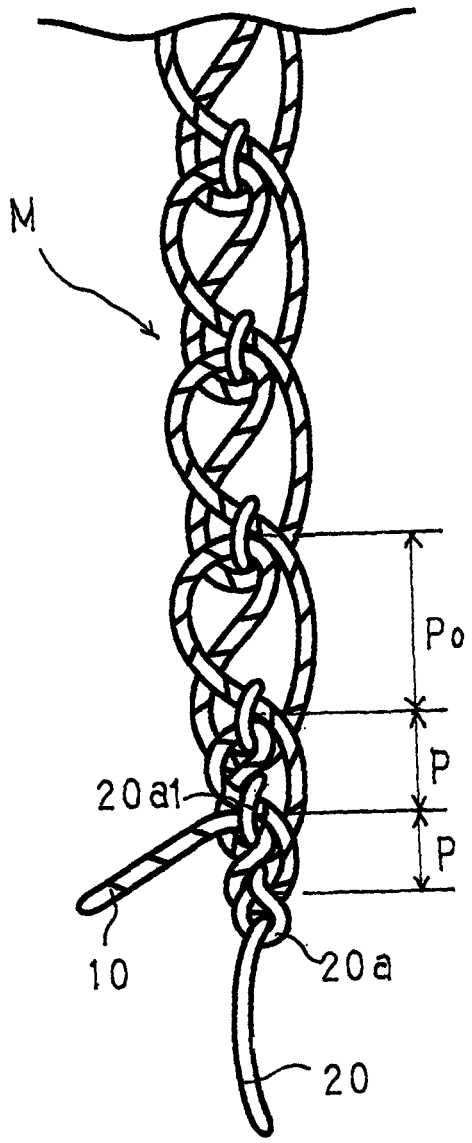
FIG. 18 is a view of a multi-thread chain stitch seam structure obtained by a horizontal tube type multi-thread chain stitch sewing machine according to the first embodiment, viewed from the rear surface of a fabric

The needle thread 20, which passes through the rear surface of the fabric during the sewing action for the one stitch for the purpose of the seam ravel prevention, passes through the final needle thread loop 20*a* formed on the rear surface of the fabric continuously with the end of the normal sewing, and selfloops the final needle thread 20*a*, thereby forming chain stitch seams M. Therefore, the looper thread 10 is pressed between the needle thread 20 and the final needle thread loop 20*a*, as shown in FIG. 18.

Additionally, the feed of the fabric at the lower feed rate by the feed dogs in the feed-reducing mechanism 83 is started at a certain stage before the sewing action for the one stitch for the purpose of the seam ravel prevention, specifically, at a certain time prior to one and a half stitches or more before the needle thread loop 20*a* is positioned closer to the forward movement end of the looper 1 than the descent position of the needle 2 by the thread hanging hook 3 (namely, at time S3 in FIG. 10). Accordingly, as shown in FIG. 18, a pitch P of seams obtained by interlooping prior to selflooping is smaller than a pitch P0 of seams obtained by the preceding interlooping, thereby increasing resistance to disengagement when the cut end portion of the looper 10 is pulled in the direction of arrow in FIG. 18. Consequently, in the state as shown in FIG. 18, the seam ravel of the multi-thread chain stitch seams M can be surely prevented by synergism of the selflooping part and the increased resistance to disengagement of the looper thread 10 owing to the smaller pitch P of the seams obtained by the interlooping prior to the selflooping.

The first embodiment also employs the structure in which the swing lever 9 in the stopper mechanism is swingingly energized by the spring 91 in the direction in which the thread hanging hook 3 in the needle thread holding mechanism is located at the standby position. Therefore, the action of the stopper member 4 in the return direction (the action in the direction in which the thread hanging hook is located at the standby position) is performed by the energizing force of the spring 9. This allows for employment of a single-acting type air cylinder as the stopper cylinder 42 for actuating the swing lever 9 that engages with and disengages from the part of the stopper member 4, thereby achieving downsizing and cost reduction of the stopper cylinder 42.

Next, a horizontal tube type multi-thread chain stitch sewing machine according to a second embodiment of the present invention is described.

The horizontal tube type multi-thread chain stitch sewing machine according to the second embodiment is identical to that described in the first embodiment, except that (i) a single needle 2 is attached via a needle fixture 13 to a lower end of a needle bar 12 so that the needle 2 is located at a portion that is displaced (offset) toward a forward movement side of the looper 1 with respect to an extension line of the center CL of the needle bar 12 moving up and down interlockingly with rotation of a sewing machine spindle (not shown) in a sewing machine arm C; and (ii) a looper thread holder 6 is included which is accessible to and departable from the looper 1, and during an access motion thereof, holds a looper thread 10 extending from the looper 1 at a position ahead of a descent position of the needle 2. Hence, the following description is focused on these two points (i) and (ii) different from the structure of the first embodiment, and the description and specific illustration of the rest are omitted here.

The single needle 2 in the second embodiment corresponds to one of two needles usually used as left and right needles of the horizontal tube type multi-thread chain stitch sewing machine, in which the right needle is removed from the needle fixture 13 and only the left needle is attached thereto. Therefore, the left needle 2 is offset toward the forward movement side of the looper 1 with respect to an extension line of a center CL of the needle bar 12. A single dedicated offset needle may be used instead of using the left needle of these left and right needles as the offset needle 2.

Some of usual multi-thread chain stitch sewing machines employ three or four needles arranged side by side in the forward and backward movement direction of the looper 1. In the case of three needles, the needle located at the center CL of the needle bar 12 and the right needle may be removed, and the left needle may be used as the single offset needle. Alternatively, the right and left needles may be removed, and only the needle located on the extension line of the center CL of the needle bar 12 may be used. In the case of four needles, needles except the leftmost one may be removed, and the leftmost needle may be used as the single offset needle.

The looper thread holder 6 has the arcuately curved shape as shown by the virtual line in FIG. 4, and is co-fastened to a base of the thread hanging hook 3 via a fixing screw 60. A front end part of the looper thread holder 6 extends forward substantially along the left side of the thread hanging hook 3, and is faced to a needle descent position A in front of a front end part of the thread hanging hook 3, and the front end part is provided with a looper thread receiving part 6*a* divided into two portions.

The looper thread holder 6 is drivingly swung around a support shaft 30 integrally with the thread hanging hook 3 of the needle thread holding mechanism by a reciprocating type thread handling cylinder 32.

FIGS. 19 to 25 are explanatory drawings for explaining a seam ravel prevention operation by a seam ravel preventing apparatus H in the horizontal tube type multi-thread chain stitch sewing machine according to the second embodiment. These drawings respectively show operational statuses of the thread hanging hook 3, the looper thread holder 6 and a thread cutting hook 50 generated by the operations of the control section 8 according to the time chart of FIG. 10.

The pedal operation from time SI to time S3 in FIG. 10 by the sewing operator, and the corresponding operations, such as operation start commands provided from the control section 8 to the feed-reducing mechanism 83, are identical to those in the first embodiment. Therefore a detailed explanation thereof is omitted here, and the subsequent operations after the seam ravel prevention operation is started are described below.

Figure 19:
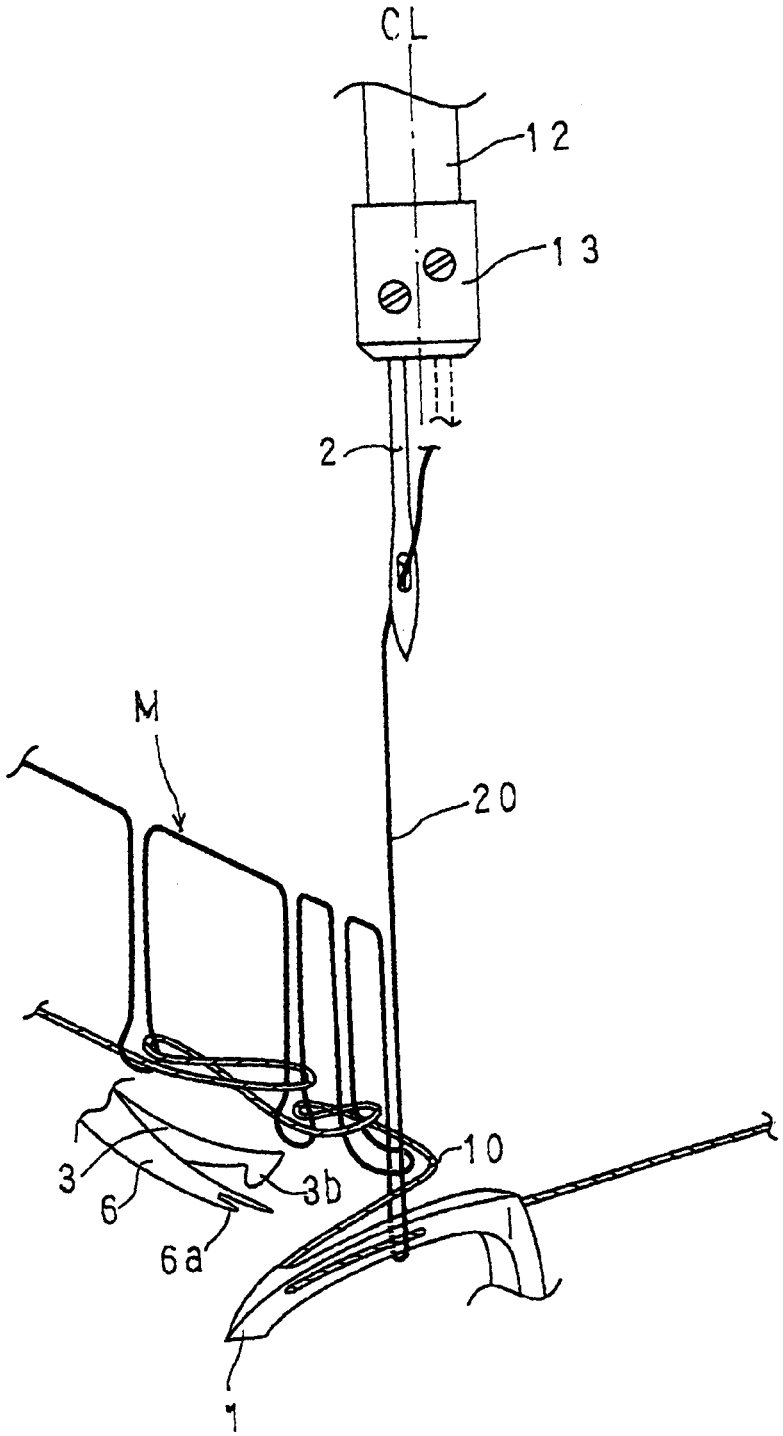
FIG. 19 is an explanatory drawing showing the structure of the main parts of a seam ravel preventing apparatus and a first seam ravel prevention action thereof in a horizontal tube type multi-thread chain stitch sewing machine according to a second embodiment of the present invention.

FIG. 19 shows the states of the needle 2, the looper 1, the thread hanging hook 3, and the looper thread holder 6 when the seam ravel prevention operation is started. The needle 2 is in a state of being passed through in an upward direction a fabric having multi-thread chain stitch seams M formed thereon by the single needle thread 20 and the single looper thread 10.

After the seam ravel prevention operation is started, the control section 8 firstly provides an operation command to the thread handling cylinder 32 on the output side at time S4 in FIG. 10. Accordingly, the thread handling cylinder 32 operates to change the expansion state as shown in FIG. 5 to the contraction state as shown in FIG. 6, and the stopper member 4 is drivingly moved rightward. Consequently, the thread hanging hook 3 and the looper thread holder 6 swing around the support shaft 30 via the stopper member 4 and the connecting rod 35, thereby moving from the standby position to the thread hooking position. At this time, the hook part 3*b* at the front end of the thread hanging hook 3 hooks the needle thread loop 20*a*, and the swing lever 9 of the stopper mechanism swings clockwise around the support shaft 90 by energizing force of the spring 91, and the engaging claw 9*a* at the front end of the swing lever 9 enters a state of being engageable with a part of the stopper member 4.

Figure 20:
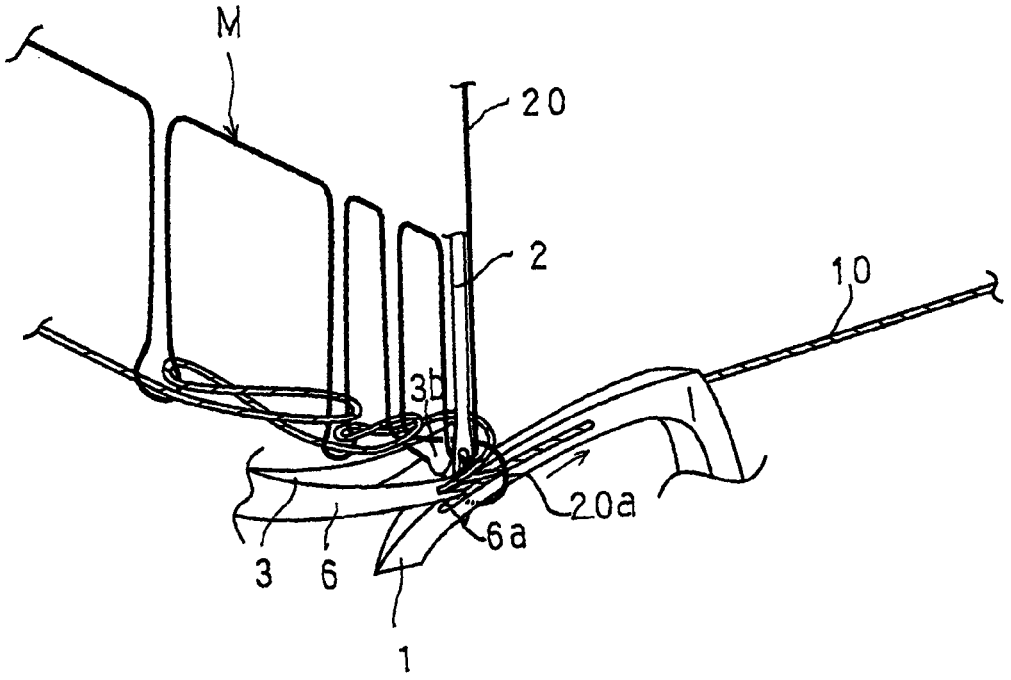
FIG. 20 is an explanatory drawing of a second seam ravel prevention action by the seam ravel preventing apparatus.
Figure 21:
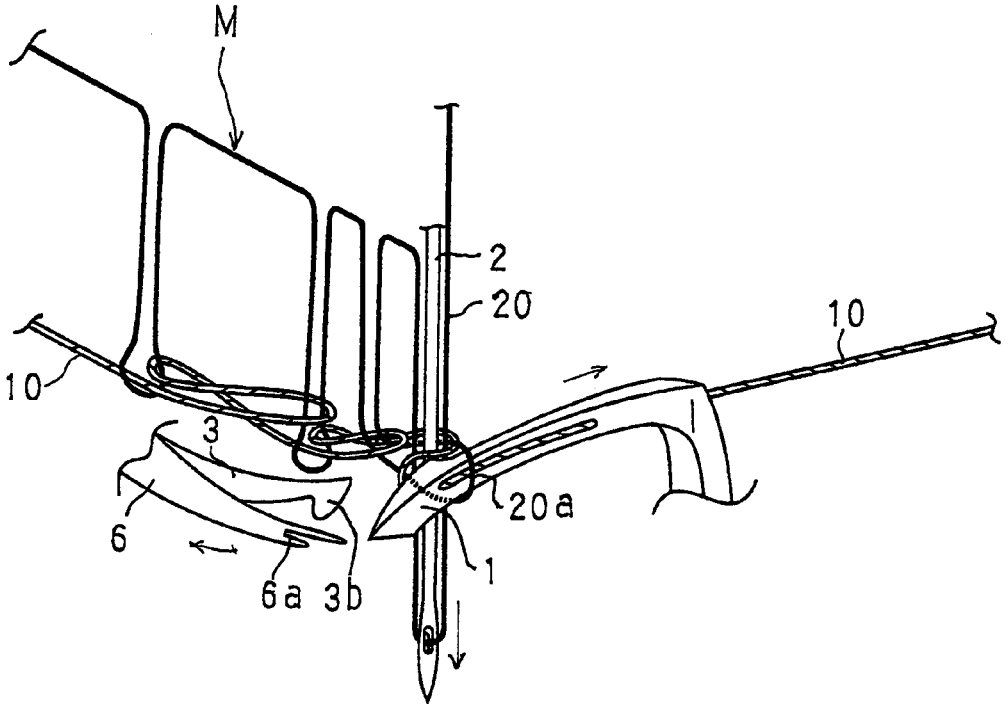
FIG. 21 is an explanatory drawing of a third seam ravel prevention action by the seam ravel preventing apparatus.

Immediately thereafter, the control section 8 provides the next operation command to the thread handling cylinder 32, so that the thread handling cylinder 32 expands somewhat from the state as shown in FIG. 6 to the state as shown in FIG. 7, and the stopper member 4 is drivingly moved linearly leftward. During the slight expansion of the thread handling cylinder 32, the engaging claw 9*a* at the front end of the swing lever 9 engages with a part of the stopper member 4, thereby suspending the leftward driving movement of the stopper member 4. In the state in which the leftward driving movement of the stopper member 4 is suspended, as shown in FIG. 20, the thread hanging hook 3 is moved via the connecting rod 35 to the hold position between the standby position and the thread hooking position. The thread hanging hook 3 stops at the hold position and holds the needle thread loop 20*a* at the hold position. The looper thread holder 6 moves forward to the front of the looper 1, and the looper thread receiving part 6*a* at the front end thereof holds the looper thread 10 at a position ahead of the needle descent position A.

After moving and stopping the thread hanging hook 3 and the looper thread holder 6 at the hold position as described above, the control section 8 provides operation commands to the sewing machine motor 80 and the looper thread restricting mechanism 84 at time S5 in FIG. 10. These operation commands are provided by referring to a needle position signal 22 in a period of time during which the needle 2 moves down and moves up again to the position near the top dead point. Accordingly, the sewing action for one stitch on the fabric is carried out. The sewing for the one stitch is carried out at a lower feed rate than during the normal sewing by the action of the feed-reducing mechanism 83. The sewing for the one stitch is also carried out in a state in which the feed of the looper thread 10 to the looper 1 is restrained by the action of the looper thread restricting mechanism 84. This improves tightness of the looper thread 10 at the end of the sewing, thereby enhancing the seam ravel prevention effect.

The thread hanging hook 3 and the looper thread holder 6 continue to hold the needle thread 20 and the looper thread 10 until the fabric feed is completed, and the needle 2 passes through the needle thread loop 20*a* held by the thread hanging hook 3 and catches the needle thread loop 20*a*, as shown in FIG. 20. At this time, the looper thread 10 is located across the front of the needle 2.

The control section 8 provides an operation command to the stopper cylinder 42 of the stopper mechanism at timing that the needle 2 catches the needle thread loop 20*a*, namely, immediately after time S6 in FIG. 10, so that the stopper cylinder 42 expands and the output rod 41 is drivingly pushed out leftward. Thereby, as shown in FIG. 8, the swing lever 9 is swung counterclockwise against the swing energizing force of the spring 91, and the engaging claw 9*a* at the front end of the swing lever 9 is disengaged from the part of the stopper member 4, and the temporary stop of the swing lever 4 is released. The release of the suspension (temporary stop) of the stopper member 4 allows the thread handling cylinder 32 to expand to its maximum at time S6. Accordingly, the thread hanging hook 3 and the looper thread holder 6 move from the hold position to the standby position by swinging around the support shaft 30 via the stopper member 4 and the connecting rod 35, thereby releasing the holding of the needle thread loop 20*a* and the looper thread 10.

Figure 22:
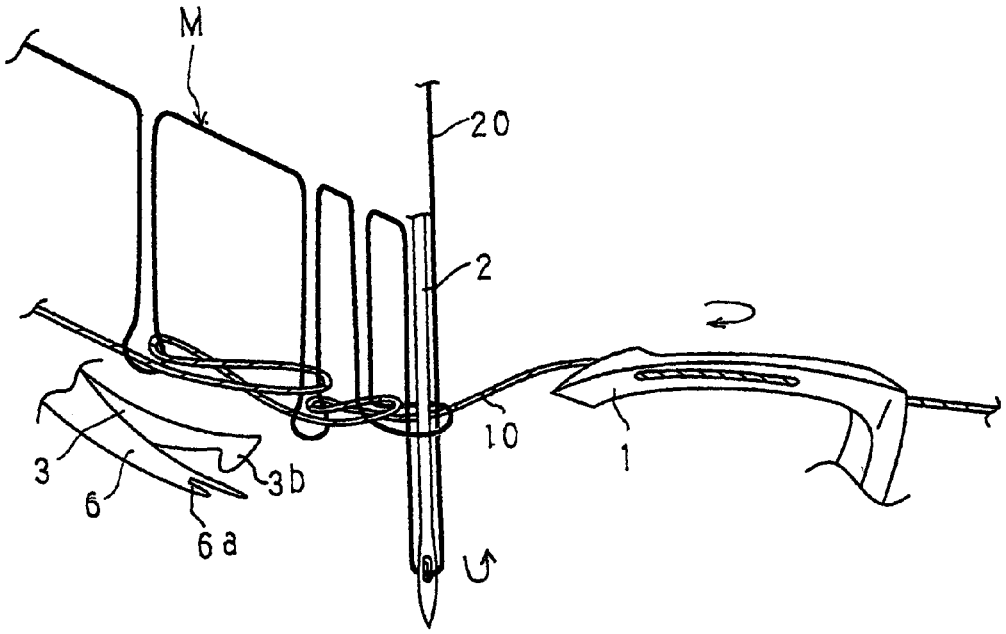
FIG. 22 is an explanatory drawing of a fourth seam ravel prevention action by the seam ravel preventing apparatus.

Next, the looper 1 performs a right backward movement as the needle 2 moves down, and slips through the caught needle thread loop 20*a*. By the looper 1 slipping therethrough, the needle 2 enters a state of catching the looper thread 10 in the same manner as during the normal sewing, as shown in FIG. 22.

Figure 23:
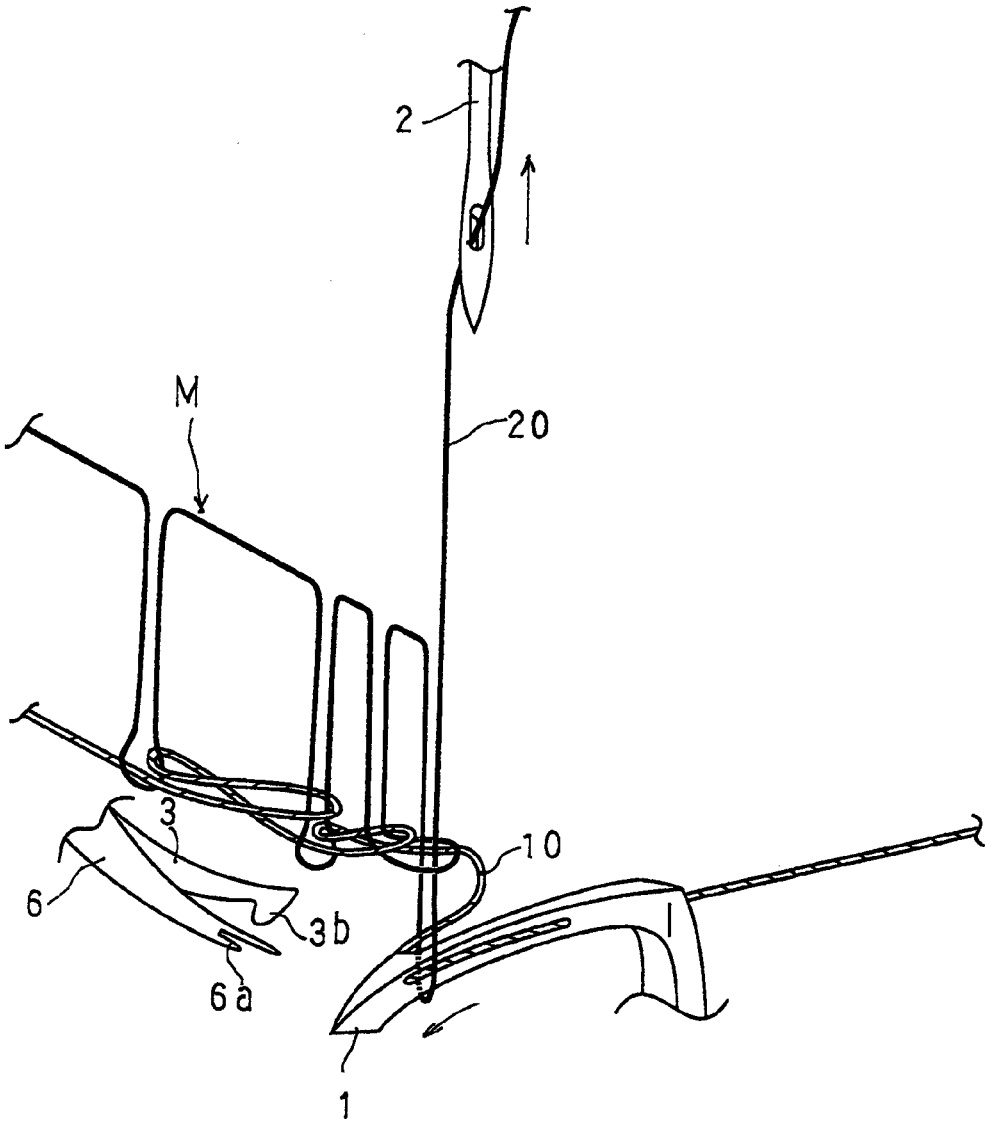
FIG. 23 is an explanatory drawing of a fifth seam ravel prevention action by the seam ravel preventing apparatus.

In this state, the looper 1 performs a left forward movement, and the needle 2 performs an upward movement. As shown in FIG. 23, the looper 1 performing the left forward movement catches the needle thread loop 20*al*, and the needle 2 performing the upward movement passes through the fabric in the upward direction. Accordingly, the needle thread 20 caught by the looper 1 performs looping the previously formed needle thread loop 20*a* with the needle thread 20, so-called selflooping.

Figure 24:
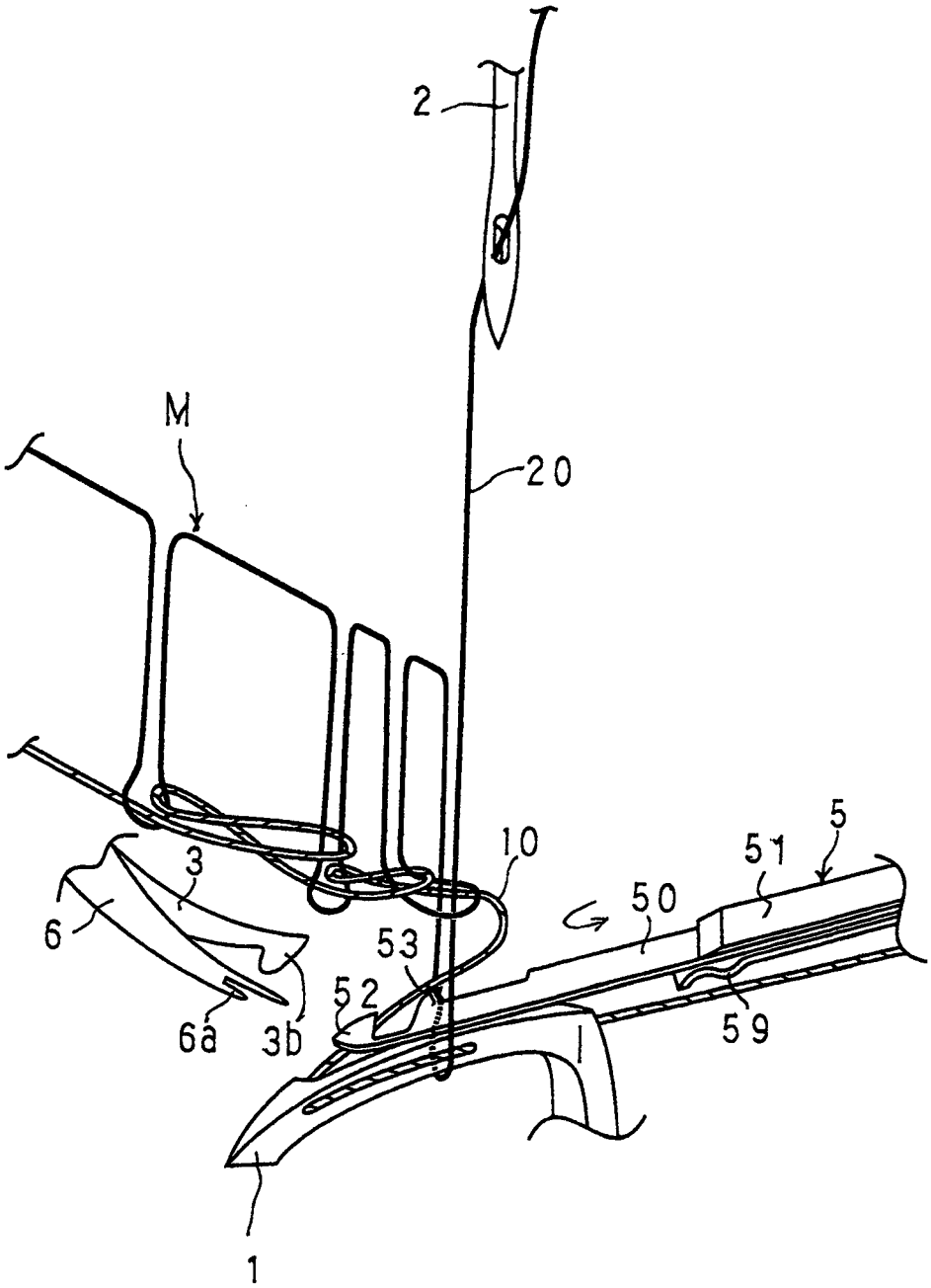
FIG. 24 is an explanatory drawing of a sixth seam ravel prevention action by the seam ravel preventing apparatus.

The sewing action for the one stitch is terminated in a state in which the needle 2 is moved to the vicinity of the top dead point, and the looper 1 reaches the vicinity of the leftward movement end. Thereafter, the control section 8 allows the feed-reducing mechanism 83 to stop operation at time S7 in FIG. 10, and holds this state until a thread cut signal 23 is applied thereto. When the thread cut signal 23 is applied at time S8 in FIG. 10, the control section 8 allows the thread cutting actuator 58 of the thread cutting mechanism to perform a predetermined operation by providing an operation command to the thread cutting actuator 58. Accordingly, the thread hanging hook 50 reaches a forward movement end along the upper part of the looper 1, as shown in FIG. 24. At this time, the first hook part 52 at the front end of the thread cutting hook 50 passes through the needle thread loop 20*a* held by the looper 1 to the left side of the looper thread 10 extending from the front end of the looper 1 to the fabric, and the second hook part 53 is opposed to the left needle thread 20 from the left side thereof.

Figure 25:
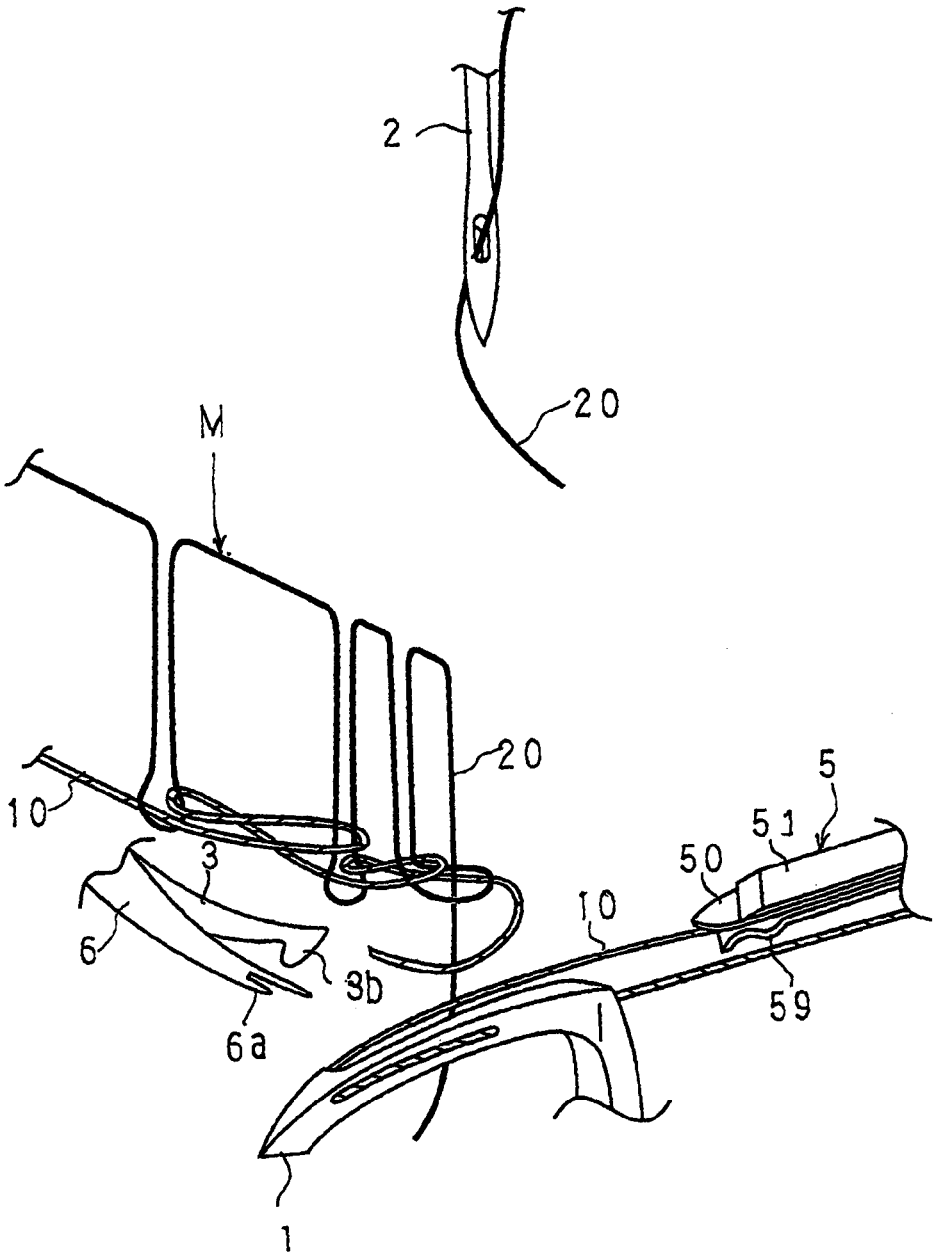
FIG. 25 is an explanatory drawing of a seventh seam ravel prevention action by the seam ravel preventing apparatus.

Subsequently, the thread cutting hook 50 located at the forward movement end performs a right backward movement. At this time, the first hook part 52 catches the looper thread 10, and the second hook part 53 catches the needle thread 20. The looper thread 10 and the needle thread 20 caught in this manner are then pulled to a retraction end of the thread cutting hook 50, and are cut by being brought into sliding contact with a cutting edge at the front end of the thread cutting knife 51, as shown in FIG. 25. An end portion of the cut looper thread 10 is held in sandwich fashion between the thread cutting hook 50 and the leaf spring 59 at a position closer to the looper l than a cutting position.

The looper thread restraining mechanism 84 continues to operate and applies a predetermined tension to the looper thread 10 extending from the front end of the looper 1 to the fabric, until the foregoing thread cutting operation is terminated. This ensures that the first hook part 52 at the front end of the thread cutting hook 50 catches and cuts the non-loose looper thread 10.

After the foregoing cutting operation, the control section 8 stands by until a needle thread wipe signal 24 is inputted thereto. When the needle thread wipe signal 24 is inputted thereto at time S9 in FIG. 10, the control section 8 allows the air wiper 82 to operate by outputting an operation command to the air wiper 82. The air wiper 82 blows out air and blows up a cut end portion of the needle thread 20 that is continuous with the needle 2. Thereafter, the control section 8 allows the presser foot cylinder 81 to act to raise the presser foot for pressing the fabric by outputting an operation command to the presser foot cylinder 81 at time S10 in FIG. 10, thereby terminating the sequence of the seam ravel prevention operation.

Similarly to the first embodiment, the foregoing sequence of the seam ravel prevention operation also produces multi-thread chain stitch seams M, as shown in FIG. 18, in the horizontal tube type multi-thread chain stitch sewing machine according to the second embodiment. Similarly to the first embodiment, the seam ravel of the multi-thread chain stitch seams M can be surely prevented by synergism of the selflooping part and the increased resistance to disengagement of the looper thread 10 owing to the smaller pitch P of the seams obtained by interlooping prior to selflooping.

Additionally, in the horizontal tube type multi-thread chain stitch sewing machine according to the second embodiment, after the normal sewing is terminated with the looper 1 set in the forward movement state, the looper thread 10 extending from the looper 1 to the fabric is held at the position ahead of the descent position of the needle 2 by the looper thread holder 6 that accesses to the looper 1. This allows not only the needle thread 20 but also the looper thread 10 to be surely positioned, thus achieving more sure selflooping and further ensuring the seam ravel prevention effect.

Also in the horizontal tube type multi-thread chain stitch sewing machine according to the second embodiment, the looper thread holder 6 is co-fastened to the thread hanging hook 3 in the needle thread holding mechanism, and is accessible to and departable from the looper 1 integrally with the thread hanging hook 3. This allows the driving mechanism of the needle thread holding mechanism to also be used as the driving mechanism of the looper thread holder 6, thereby downsizing, simplifying and reducing costs of the entirety of the seam ravel preventing apparatus H as much as possible.

Figure 26:
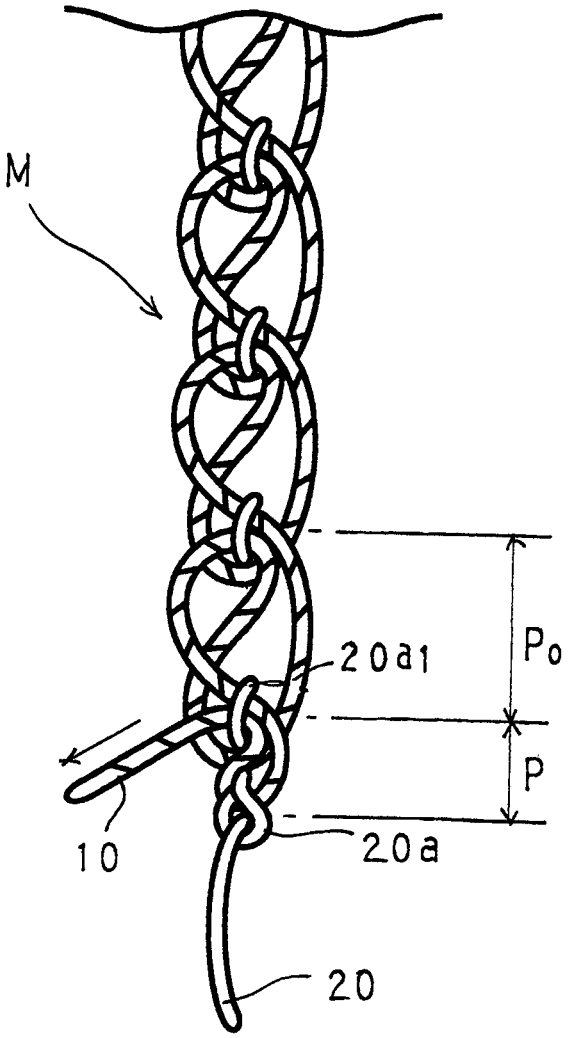
FIG. 26 is a diagram of a multi-thread chain stitch seam structure obtained by actions different from those of the first or second embodiment, viewed from the rear surface of a fabric.

In both the first and second embodiments, the fabric feed at the lower feed rate by the feed dogs in the feed-reducing mechanism 83 is set to start prior to the sewing action for one stitch for the purpose of the seam ravel prevention and also prior to at least one and a half stitches or more before the needle thread loop 20*a* is positioned closer to the forward movement end of the looper than the descent position of the needle 2 by the thread hanging hook 3 (namely, at time S3 in FIG. 10). However, the present invention is not limited thereto. For example, the fabric feed at the lower feed rate by the feed dogs in the feed-reducing mechanism 83 may be set to be started prior to the sewing action for one stitch for the purpose of the seam ravel prevention and also prior to substantially a half stitch before the needle thread loop 20*a* is positioned closer to the forward movement end of the looper than the descent position of the needle 2 by the thread hanging hook 3. This case also ensures looping the previously formed needle thread loop 20*a* with the needle thread 20 caught by the looper 1, so-called selflooping, as shown in FIG. 26, thereby producing the seam ravel prevention effect.

Although the second embodiment has described the structure in which the looper thread holder 6 is accessible to and departable from the looper 1 integrally with the thread hanging hook 3 in the needle thread handling mechanism, the looper thread holder 6 may be accessible to and departable from the looper 1 separately from the thread hanging hook in the needle thread holding mechanism.

Although the second embodiment has described the structure in which the looper thread holder 6 moves forward to the front of the looper 1 and the looper thread receiving part 6*a* at the front end thereof holds the looper thread 10 at a position ahead of the needle descent position A, as shown in FIG. 20, the looper thread holder 6 may move forward to the rear of the looper 1 and the looper thread receiving part 6*a* at the front end thereof may hold the looper thread 10 at a position behind the needle descent position A.

Especially, the looper thread 10 can be configured to be held behind the needle descent position A by allowing the looper thread holder 6 to be operated separately from the thread hanging hook 3. In this case, a driving mechanism dedicated for the action of the looper thread holder 6 may be installed ahead of the needle descent position A.

When the looper thread holder 6 is allowed to access to and depart from the looper 1 integrally with or separately from the thread hanging hook 3 in the needle thread holding mechanism, it is preferable to configure so that access and departure timing and/or a locus of action of the looper thread holder 6 with respect to the looper 1 is adjustable.

In this case, for example, before an actual sewing, a mechanical running test (trial sewing) can be performed to inspect the timing of action and/or the locus of action of the looper thread holder 6 with respect to the needle thread holding mechanism. Then, on the basis of the inspection results, optional adjustments for obtaining appropriate timing of action and/or locus of action can be performed to avoid mutual adverse effects and action disorder between the looper thread holder 6 and the thread hanging hook 3 in the needle thread holding mechanism. Consequently, the coexistence and cooperation of the looper thread holder 6 and the thread hanging hook 3 in the needle thread holding mechanism further ensure the selflooping and further enhance the intended seam ravel prevention effect.

Although the foregoing embodiments have described the case of using the air cylinders having excellent operational response as the hook actuator and the stopper actuator, electromagnetic solenoids or the like may be used as these two actuators.

In the structures of the foregoing embodiments, the needle plate base 11 for attaching the seam ravel preventing apparatus H is divided into the two parts of the left needle plate base 11L and the right needle plate base 11R, thereby improving ease of installation and ease of maintenance of the seam ravel preventing apparatus H with respect to the sewing machine bed B. The needle plate base 11 in the seam ravel preventing apparatus H may be one united body that is laterally long.

Although the foregoing embodiments are intended for the I-needle horizontal tube type multi-thread chain stitch sewing machine, the individual embodiments may be applied to a flat-bed multi-thread chain stitch sewing machine.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

I claim:

1. A method for preventing seam ravel of multi-thread chain stitches formed by catching a needle thread loop formed below a needle plate by a needle moving up and down while holding a needle thread, by a forward movement of a looper movable forward and backward in a direction substantially orthogonal to a vertical movement path of the needle, and by interlooping the needle thread loop with a looper thread held by the looper, the method comprising the steps of:

after a normal sewing is terminated with the looper set in a forward movement state, maintaining a state in which the needle thread loop caught by the looper is subjected to position holding at a position closer to a forward movement end of the looper than a descent position of the needle until the needle descends through the needle thread loop caught by the looper; and thereafter, selflooping the needle thread loop with the needle thread held by the needle by releasing the position holding of the needle thread loop to permit a sewing action for at least one stitch which includes a descent of the needle through the needle thread loop, under conditions that feed of a fabric is suspended, or that feed has a lower feed rate than during the normal sewing;

concurrently or substantially concurrently with subjecting the needle thread loop caught by the looper to the position holding at the position closer to the forward movement end of the looper than the descent position of the needle, subjecting a looper thread extending from the looper to the fabric to position holding at a position ahead of or behind the descent position of the needle, and then suppressing feed of the looper thread to the looper; and making setting so that execution of suspension of the feed of the fabric or the feed having the lower feed rate than during the normal sewing in the sewing action for the at least one stitch for the self-looping is started at a certain stage before the needle thread loop is positioned closer to the forward movement end of looper than the descent position of the needle.

2. The method for preventing seam ravel of multi-thread chain stitches according to claim 1, wherein setting is made so that the execution of the suspension of the feed of the fabric or the execution of the feed having the lower feed rate than during the normal sewing in the sewing action for the at least one stitch for the selflooping starts at a certain time prior to at least one and a half stitches or more before the needle thread loop is positioned closer to the forward movement end of the looper than the descent position of the needle.

3. A seam ravel preventing apparatus for a multi-thread chain stitch sewing machine which is installed in the multi-thread chain stitch sewing machine for forming multi-thread chain stitch seams on a fabric, and for preventing ravel of the seams, wherein the multi-thread chain stitch sewing machine comprises a single needle moving up and down while holding a needle thread, and a looper which is movable forward and backward while holding a looper thread in a direction substantially orthogonal to a vertical movement path of the needle, and catches a needle thread loop formed below a needle plate by the needle during a forward movement of the looper, and wherein the multi-thread chain stitch sewing machine forms the multi-thread chain stitch seams by interlooping the needle thread loop caught by the forward movement action of the looper with the looper thread held by the looper, the seam ravel preventing apparatus comprising:

a needle thread holding mechanism which is accessible to and departable from the looper, and holds the needle thread loop caught by the looper during an access motion of the needle thread holding mechanism, at a position closer to a forward movement end of the looper than a descent position of the needle;

a feed reducing mechanism for adjusting a fabric feeding rate;

a looper-thread restraining mechanism for restraining the feed of the looper thread to the looper; and a control section for controlling the access motion and a departure motion of the needle thread holding mechanism in association with actions of the needle and the looper, and feed of the fabric, wherein the control section terminates a normal sewing by setting the looper at a forward movement position and the needle at an ascent position, and then maintains a state in which the needle thread loop is subjected to position holding at a position closer to the forward movement end of the looper than a descent position of the needle by allowing the needle thread holding mechanism to create the access motion, until the needle descends through the needle thread loop caught by the looper, and thereafter, the control section releases the position holding of the needle thread loop to perform a sewing action for at least one stitch which includes a descent of the needle through the needle thread loop in synchronization with descent and ascent of the needle, the forward and backward movements of the looper, and the feed of the fabric, wherein the needle thread loop is selflooped with the needle thread held by the needle by subjecting the sewing action to a control operation to be performed under the conditions that feed of the fabric is suspended or feed has a lower rate than during the normal sewing by adjustment made by the feed reducing mechanism;

wherein the seam ravel preventing apparatus further comprises:

a looper threadholder being accessible to and departable from the looper and holds the looper thread extending from the looper to the fabric during an access motion of the looper threadholder at a position ahead of or behind the decent position of the needle;

wherein the control section performs a control operation comprising:

concurrently or substantially concurrently with subjecting the needle thread loop caught by the looper to the position holding at the position closer to the forward movement end of the looper than the descent position of the needle, subjecting the looper thread extending from the looper to the fabric to position holding at the position ahead of or behind the descent position of the needle; and then causing the looper-thread restraining mechanism to operate to suppress feed of the looper thread to the looper; and wherein setting is made so that execution of the suspension of the feed of the fabric or execution of the feed having the lower feed rate than during the normal sewing, which is to be adjusted by the feed reducing mechanism in the sewing action for the at least one stitch for the selflooping, is started at a certain stage before th needle loop is positioned closer to the forward movement end of the looper than the descent position of the needle.

4. The seam ravel preventing apparatus for the multi-thread chain stitch sewing machine according to claim 3, wherein the needle thread holding mechanism comprises a thread hanging hook which swings around a vertically extending support shaft in a plane substantially parallel to the needle plate between a standby position away from the looper and a hooking position adjacent to the looper; and a hook actuator for drivingly swinging the thread hanging hook to the standby position and the hooking position, wherein the needle thread holding mechanism further comprises:

a stopper mechanism having (i) a stopper member disposed at a position farther away from the needle plate than the thread hanging hook of the needle thread holding mechanism, and performs suspension and unsuspension of a swing of the thread hanging hook from the hooking position to the standby position so that the needle thread loop caught by the thread hanging hook at the thread hooking position is held at a hold position between the thread hooking position and the standby position, and (ii) a stopper actuator for performing the suspension and the unsuspension of the stopper member; and a connecting member for interlockingly connecting the thread hanging hook of the needle thread holding mechanism and the stopper member of the stopper mechanism, and wherein the control section allows the needle thread loop caught at the thread hooking position by the thread hanging hook to be held between the thread hooking position and the standby position in abutment against the stopper member by selectively controlling the hook actuator and the stopper actuator.

5. The seam ravel preventing apparatus for the multi-thread chain stitch sewing machine according to claim 4, wherein the stopper mechanism comprises:

a stopper member which is directly connected to the hook actuator and moves linearly reciprocatingly;

a swing lever engageable with and disengageable from a part of the stopper member;

a spring for swingingly energizing the swing lever in a direction in which the thread hanging hook is positioned at the standby position; and the stopper actuator for disengaging the swing lever from the part of the stopper member against an energizing force of the spring.

6. The seam ravel preventing apparatus for the multi-thread chain stitch sewing machine according to claim 3, wherein the looper thread holder is accessible to and departable from the looper integrally with the needle thread holding mechanism.

7. The seam ravel preventing apparatus for the multi-thread chain stitch sewing machine according to claim 3, wherein time that the control section starts the execution of the suspension of the feed of the fabric or the execution of the feed having the lower feed rate than during the normal sewing in the sewing action for the at least one stitch for the selflooping is set at a certain time prior to at least one and a half stitches or more before the needle thread loop is positioned closer to the forward movement end of the looper than the descent position of the needle.

* * * * *